US010041225B2

(12) United States Patent
Mizuochi et al.

(10) Patent No.: US 10,041,225 B2
(45) Date of Patent: Aug. 7, 2018

(54) DRIVE CONTROL SYSTEM FOR WORK MACHINE

(71) Applicant: HITACHI CONSTRUCTION MACHINERY CO., LTD., Tokyo (JP)

(72) Inventors: Mariko Mizuochi, Tsuchiura (JP); Akinori Ishii, Ushiku (JP); Kazuyoshi Hanakawa, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 15/447,654

(22) Filed: Mar. 2, 2017

(65) Prior Publication Data

US 2017/0284056 A1 Oct. 5, 2017

(30) Foreign Application Priority Data

Mar. 30, 2016 (JP) ..... 2016-069590

(51) Int. Cl.

| | |
|---|---|
| ***G06F 7/70*** | (2006.01) |
| ***G06F 19/00*** | (2018.01) |
| ***G06G 7/00*** | (2006.01) |
| ***G06G 7/76*** | (2006.01) |
| ***E02F 3/43*** | (2006.01) |
| ***E02F 9/20*** | (2006.01) |
| ***E02F 3/32*** | (2006.01) |
| ***E02F 9/22*** | (2006.01) |
| ***E02F 9/26*** | (2006.01) |
| ***E02F 3/42*** | (2006.01) |
| *G01M 1/38* | (2006.01) |
| *G05B 13/00* | (2006.01) |
| *G05B 15/00* | (2006.01) |

(Continued)

(52) U.S. Cl.

CPC ..... *E02F 3/435* (2013.01); *E02F 3/32* (2013.01); *E02F 3/425* (2013.01); *E02F 9/2004* (2013.01); *E02F 9/2203* (2013.01); *E02F 9/2228* (2013.01); *E02F 9/2285* (2013.01); *E02F 9/268* (2013.01); *E02F 3/964* (2013.01)

(58) Field of Classification Search

CPC ... E02F 3/435; E02F 3/32; E02F 3/964; E02F 3/425; E02F 9/2004; E02F 9/2203; E02F 9/2228; E02F 9/2285; E02F 9/268; E02F 9/265; G05B 15/02

USPC ..... 701/50; 700/275

See application file for complete search history.

(56) References Cited

U.S. PATENT DOCUMENTS

2007/0289171 A1* 12/2007 Way ..... B60T 8/448 37/231
2014/0121840 A1* 5/2014 Mizuochi ..... E02F 9/265 700/275

FOREIGN PATENT DOCUMENTS

| | | |
|---|---|---|
| JP | 10-311064 A | 11/1998 |
| JP | 2871105 B | 3/1999 |
| WO | 2012/169531 A1 | 12/2012 |

* cited by examiner

*Primary Examiner* — Mahmoud S Ismail
(74) *Attorney, Agent, or Firm* — Mattingly & Malur, PC

(57) ABSTRACT

A drive control system for a work machine. A gradual stoppage command and an operation speed limitation command are calculated and output. A pilot pressure is corrected such that, upon a stoppage operation of a control lever, a drive actuator is stopped gradually; and the pilot pressure is corrected such that an operation speed of the drive actuator is limited. A supply of the pilot hydraulic fluid to the speed (Continued)

increasing unit is interrupted when a failure of a speed increasing solenoid proportional valve of the speed increasing unit is detected.

5 Claims, 13 Drawing Sheets

(51) Int. Cl.
*G05D 23/00* (2006.01)
*E02F 3/96* (2006.01)

DRIVE CONTROL SYSTEM FOR WORK MACHINE

BACKGROUND OF THE INVENTION

1. Field of the Invention

The present invention relates to a drive control system for a work machine used for structure demolition works, waste disposal, scrap handling, road works, construction works, civil engineering works, and so forth.

2. Description of the Related Art

Work machines including a track structure for traveling by use of a power system, a swing structure mounted on the top of the track structure to be swingable, a front work implement of the multijoint type attached to the swing structure to be pivotable in the vertical direction, and actuators each of which drives a corresponding front member constituting the front work implement are well known as work machines used for structure demolition works, waste disposal, scrap handling, road works, construction works, civil engineering works, and so forth. As an example of such a work machine, there is a work machine configured based on a hydraulic excavator and including a boom whose one end is pivotably connected to the swing structure, an arm whose one end is pivotably connected to the tip end of the boom, and an attachment such as a grapple, bucket, breaker or crusher attached to the tip end of the arm so that an intended work can be performed.

This type of work machine performs the work while changing its attitude in various ways with the boom, the arm and the attachment of the front work implement projecting outward from the swing structure. Thus, the work machine can lose balance when the operator performs a forceful operation such as putting an excessive workload on a part of the work machine or conducting a sudden stoppage in a state with an excessive load and the front work implement expanded. Therefore, a variety of overturn prevention technologies have been proposed for this type of work machines.

For example, in a technology disclosed in Japanese Patent No. 2871105, angle sensors are provided on the boom and the arm of the work machine and a detection signal from each angle sensor is inputted to a control unit. The control unit calculates the barycenter position of the entire work machine and support force of each stable supporting point at the grounding surface of the track structure based on the detection signals. Support force values at the stable supporting points based on the result of the calculation are displayed on a display device. A warning is issued when the support force at a rear stable supporting point has decreased below a limit value for securing the work.

On the other hand, a work machine for performing the aforementioned demolition work carries out the work by driving the track structure, the swing structure and the front work implement that are massive. Thus, if the operator performs an operation for suddenly stopping the driving of the currently moving track structure, swing structure or front work implement for some reason, strong inertial force acts on the work machine and significantly affects the stability of the work machine. Especially when the operator hastily performs an operation for stopping the driving of the currently moving track structure, swing structure or front work implement in response to a warning of a possibility of the overturn from a warning device installed in the work machine, strong inertial force can be added in an overturn direction and that can adversely increase the possibility of the overturn.

To deal with this kind of problem, WO 2012/169531 discloses a control technology, in which variations in the stability until the work machine reaches the complete stoppage in a case where a control lever has been instantaneously returned from an operation state to a stoppage command state are predicted by using a sudden stoppage model and positional information on movable parts of the track structure and the main body including the front work implement, and operation limitation on drive actuators is performed so that no instability occurs at any time till the stoppage.

On the other hand, JP-1998-311064-A discloses a hydraulic pilot type drive hydraulic circuit that causes, when a solenoid proportional valve suffers from sticking, an solenoid selector valve for interruption to be closed to interrupt the flow path of pilot hydraulic fluid to the solenoid proportional valve so as to stop the actuator.

SUMMARY OF THE INVENTION

By applying the technology described in WO 2012/169531 to a work machine, the overturn of the work machine can be prevented and the work can be continued in a stable condition even when a motion is suddenly stopped due to the operator's forceful or erroneous operation. The technology described in WO 2012/169531 is a technology of limiting the operation of a drive actuator of a work machine based on the result of a control calculation.

In general, the driving of a drive actuator of a work machine is controlled by a hydraulic pilot type drive hydraulic circuit including a pilot type flow control valve for controlling the supply of the hydraulic fluid to the drive actuator and a proportional pressure reducing valve for outputting pilot hydraulic fluid to the flow control valve according to the operator's operation on a control lever.

To perform the operation limitation on a drive actuator by applying the technology described in WO 2012/169531 to such a work machine, control means for changing the supply of the hydraulic fluid to the actuator according to the result of the control calculation has to be installed in the drive hydraulic circuit. However, the conventional technology has disclosed no configuration for implementing the operation limitation in a work machine including a hydraulic pilot type drive hydraulic circuit. Further, if the configuration of the drive hydraulic circuit is greatly modified for the installation of the control means in the drive hydraulic circuit, there is a danger that the responsiveness or the like changes and the conventional operability is impaired.

Further, if it is tried to incorporate control means for changing the supply of hydraulic fluid to the actuator in response to a result of a control calculation into the drive hydraulic circuit to perform control intervention in the operation of the drive actuator, then such a configuration may be adopted that a controlling solenoid proportional valve is provided in a pilot line that connects a pilot pump and a flow control valve such that the controlling solenoid proportional valve is rendered operative on the basis of a result of a control calculation. However, such a configuration as just described has a concern that, if the controlling solenoid proportional valve sticks from biting of a foreign article or from a like reason, then the pilot hydraulic fluid may continue to be outputted from the controlling solenoid proportional valve against an intention of the operator or a result of the control calculation, resulting in failure to stop the drive actuator.

In the technology disclosed in JP-1998-311064-A, a hydraulic pilot type drive hydraulic circuit for a hydraulic excavator that is a work machine having an offset boom includes: a solenoid proportional valve that retracts, when a distal end of the work machine advances into an interference prevention region, the distal end of the work machine from the interference prevention region; and two solenoid proportional valves for causing left and right offset operations to be performed in response to a switch operation. In such a hydraulic circuit as just described, operation limitation necessary to keep the work machine stable cannot be implemented by a configuration that can maintain the conventional operability.

The present invention has been made to solve the subjects described above, and it is an object of the present invention to provide a drive control system for a work machine which can implement operation limitation necessary to keep the work machine stable using a configuration that can maintain the conventional operability and can avoid, even if some trouble occurs with a controlling solenoid proportional valve provided in a pilot line, an unintended operation of the drive actuator and which is high in operability and stability.

To achieve the object described above, according to the present invention, there is provided a drive control system for a work machine including: a work machine main body; a front work implement attached pivotably in an upward and downward direction with respect the work machine main body and having a plurality of movable parts; a drive actuator configured to drive each of the movable parts of the front work implement; a calculation device configured to perform a control calculation for controlling driving of the drive actuator; an actuator drive hydraulic circuit including a flow control valve configured to control supply of hydraulic fluid to the drive actuator, and a proportional pressure reducing valve configured to output pilot hydraulic fluid to be supplied to the flow control valve based on an operation of a control lever; a lever operation amount detection unit configured to detect an operation amount of the control lever; and an attitude detection unit configured to detect an attitude of the work machine. The calculation device includes a stability judgment section configured to predict, based on the operation amount of the control lever detected by the lever operation amount detection unit and the attitude of the work machine detected by the attitude detection unit, a behavior of the work machine when it is assumed that the work machine stops suddenly and judge stability of the work machine, and an operation limitation determination section configured to calculate and output a gradual stoppage command for limiting a deceleration of the drive actuator based on a result of the judgment of the stability judgment section to gradually stop the drive actuator and an operation speed limitation command for limiting an upper limit operation speed of the drive actuator. The actuator drive hydraulic circuit includes a pilot pressure correction unit configured to correct a pilot pressure to be outputted from the proportional pressure reducing valve in response to the gradual stoppage command and the operation speed limitation command from the operation limitation determination section. The pilot pressure correction unit is configured from a stoppage characteristic modification unit configured to correct the pilot pressure such that the drive actuator is stopped gradually upon a stoppage operation of the control lever, and an operation speed limitation unit configured to correct the pilot pressure such that the operation speed of the drive actuator is limited. The stoppage characteristic modification unit and the operation speed limitation unit are individually driven by the gradual stoppage command and the operation speed limitation command from the operation limitation determination section such that, when the gradual stoppage command and the operation speed limitation command are inputted from the operation limitation determination section, the pilot pressure to be outputted from the proportional pressure reducing valve is corrected, but when the gradual stoppage command and the operation speed limitation command are not inputted from the operation limitation determination section, the pilot pressure outputted from the proportional pressure reducing valve is supplied to the flow control valve without being corrected. The stoppage characteristic modification unit includes a speed increasing unit provided on a pilot line that connects the proportional pressure reducing valve and the flow control valve, the speed increasing unit including a speed increasing solenoid proportional valve connected to a pilot hydraulic fluid supply device other than the proportional pressure reducing valve so as to generate and output a pressure higher than a pilot pressure outputted from the proportional pressure reducing valve. The operation speed limitation unit includes a speed reducing unit configured to reduce and output the pilot pressure. The drive control system further includes a failure detection unit configured to detect a failure of the speed increasing solenoid proportional valve included in the speed increasing unit. The actuator drive hydraulic circuit further includes a speed increase interruption unit configured to interrupt supply of the pilot hydraulic fluid from the pilot hydraulic fluid supply device other than the proportional pressure reducing valve to the speed increasing unit. The calculation device causes, when a failure of the speed increasing solenoid proportional valve is detected by the failure detection unit, the speed increase interruption unit to interrupt supply of the pilot hydraulic fluid to the speed increasing unit.

With the drive control system for a work machine, operation limitation according to a stability state of the work machine is performed by the configuration that takes advantage of the conventional actuator drive circuit, and operation limitation can be performed without damaging the operability and the work machine can be kept stable. Further, even when some trouble occurs with the controlling solenoid proportional valve (speed increasing solenoid proportional valve) provided in the pilot line, an unintended operation of the drive actuator can be avoided while an operation of the drive actuator by a lever operation is taken advantage of.

DESCRIPTION OF THE PREFERRED EMBODIMENTS

In the following, an embodiment of the present invention is described with reference to the drawings.

First Embodiment

A drive control system for a work machine according to a first embodiment of the present invention is described with reference to FIGS. 1 to 9B.

<Work Machine>

Figure 1:
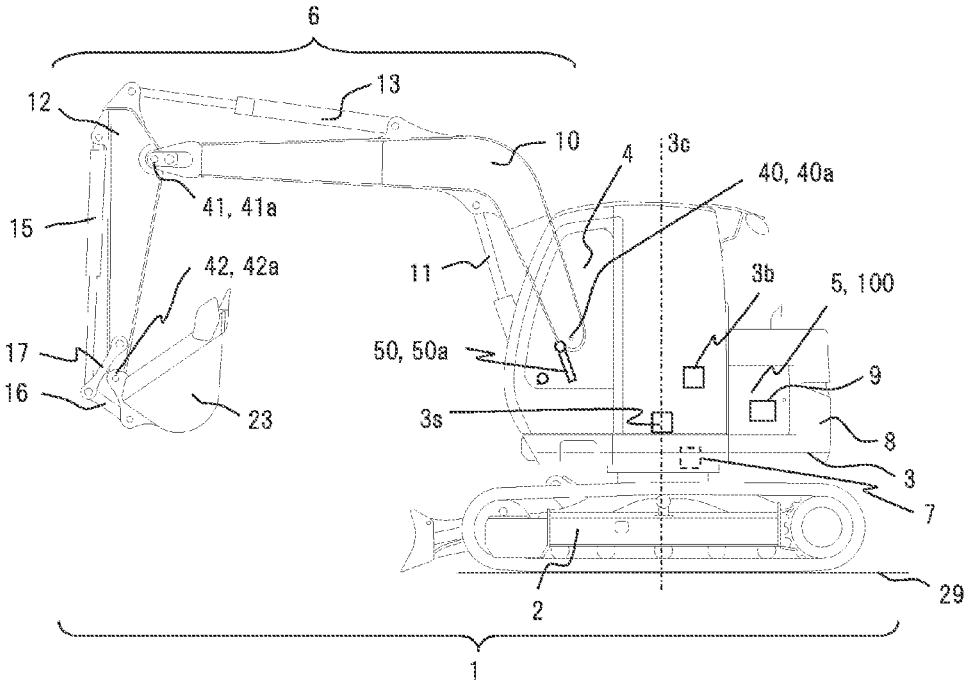
FIG. 1 is a side elevational view of a work machine according to a first embodiment of the present invention.

As depicted in FIG. 1, a work machine 1 in which the drive control system according to the present embodiment is incorporated includes a track structure 2, a swing structure 3 swingably attached at an upper portion of the track structure 2, and a front work implement 6 formed of a multijoint link mechanism with an end connected to the swing structure 3.

Figure 9:
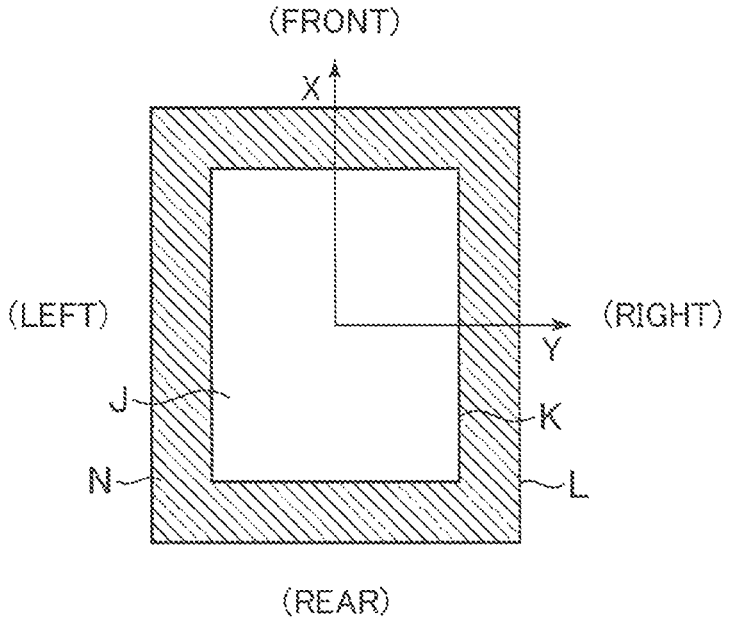
FIG. 9 is a view illustrating a stability evaluation method according to the first embodiment.

The swing structure 3 is driven to swing around the central axis 3*c* by a swing motor 7. A cab 4 and a counter weight 8 are mounted on the swing structure 3. Further, an engine 5 configuring a power system and a drive control system 9 that controls the startup/stoppage and the overall operation of the work machine 1 are provided at a suitable location of the swing structure 3. The drive control system 9 includes a drive hydraulic circuit 100 for a drive actuator (hereinafter described). The reference character 29 in FIG. 9 represents the ground surface.

The front work implement 6 has a boom 10 (movable part) connected at one end thereof to the swing structure 3, an arm 12 (movable part) connected at one end thereof to the other end of the boom 10, and an attachment 23 (movable part) connected at one end thereof to the other end of the arm 12. Each of these members is configured to rotate in the vertical direction.

A boom cylinder 11 is a drive actuator that rotates the boom 10 around a supporting point 40 and is connected to the swing structure 3 and the boom 10. An arm cylinder 13 is a drive actuator that rotates the arm 12 around a supporting point 41 and is connected to the boom 10 and the arm 12. An attachment cylinder 15 is a drive actuator that rotates the attachment 23 around a supporting point 42 and is connected to the attachment 23 through a link 16 and to the arm 12 through another link 17. The attachment 23 is arbitrarily exchangeable to a work tool not depicted such as a magnet, a grapple, a cutter, a breaker or a bucket. The swing motor 7 is a drive actuator that drives the swing structure 3.

Provided in the cab 4 are a plurality of control levers 50 for letting the operator input commands in regard to the operation of each drive actuator.

<Actuator Drive Hydraulic Circuit in General Work Machine>

Figure 2A:
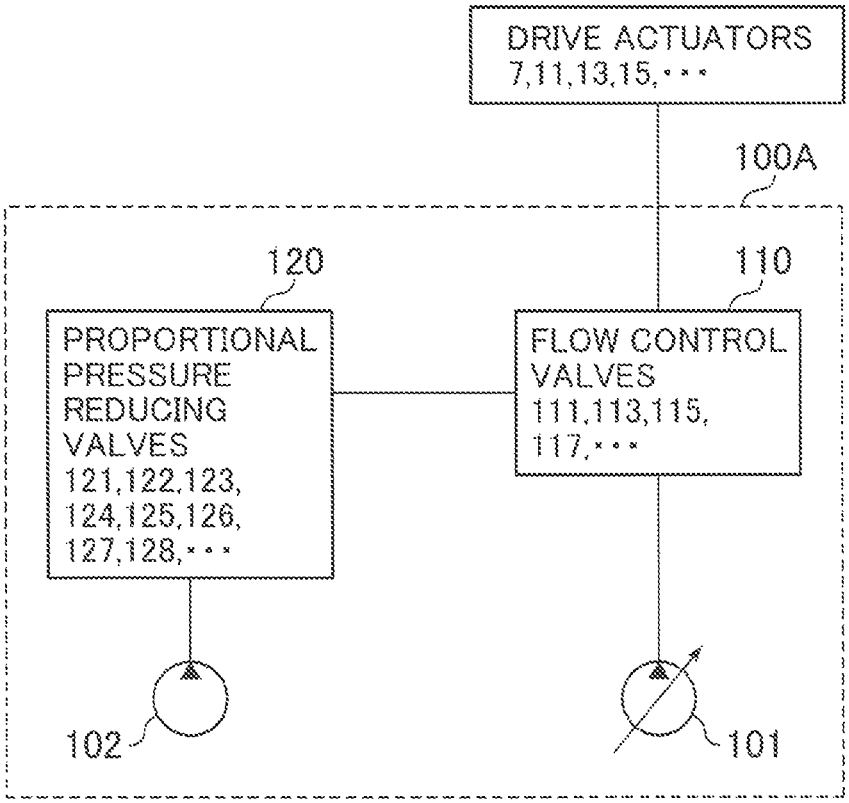
FIG. 2A is a conceptual view of a general drive hydraulic circuit of a drive actuator of a general work machine.

FIG. 2A depicts a conceptual view of an entire actuator drive hydraulic circuit in a general work machine having a hydraulic pilot type operation device.

Referring to FIG. 2A, the drive actuators 7, 11, 13, 15, . . . of the work machine 1 are driven by hydraulic fluid supplied from a main pump 101. A drive hydraulic circuit 100A is a circuit for supplying hydraulic fluid to the drive actuators 7, 11, 13, 15, . . . and is configured principally from the main pump 101 and a pilot pump 102, a flow control valve set 110 of the pilot type, and a proportional pressure reducing valve set 120. The main pump 101 and the pilot pump 102 are driven by the engine 5. The flow control valve set 110 of the pilot type is connected to the main pump 101 for controlling the supply flow rate to the drive actuators. The proportional pressure reducing valve set 120 is connected to the pilot pump 102 for generating pilot hydraulic fluid to be supplied to the flow control valve set 110 in response to the plurality of control levers 50 being operated.

The flow control valve set 110 includes an boom flow control valve 111, an arm flow control valve 113, an attachment flow control valve 115, and a swing flow control valve 117. The proportional pressure reducing valve set 120 includes a boom expansion proportional pressure reducing valve 121, a boom contraction proportional pressure reducing valve 122, an arm expansion proportional pressure reducing valve 123, an arm contraction proportional pressure reducing valve 124, an attachment expansion proportional pressure reducing valve 125, an attachment contraction proportional pressure reducing valve 126, a right swing proportional pressure reducing valve 127 and a left swing proportional pressure reducing valve 128.

It is to be noted that driving methods for the drive actuators are similar to each other, and therefore, description is given taking the boom cylinder 11 as an example.

Figure 2B:
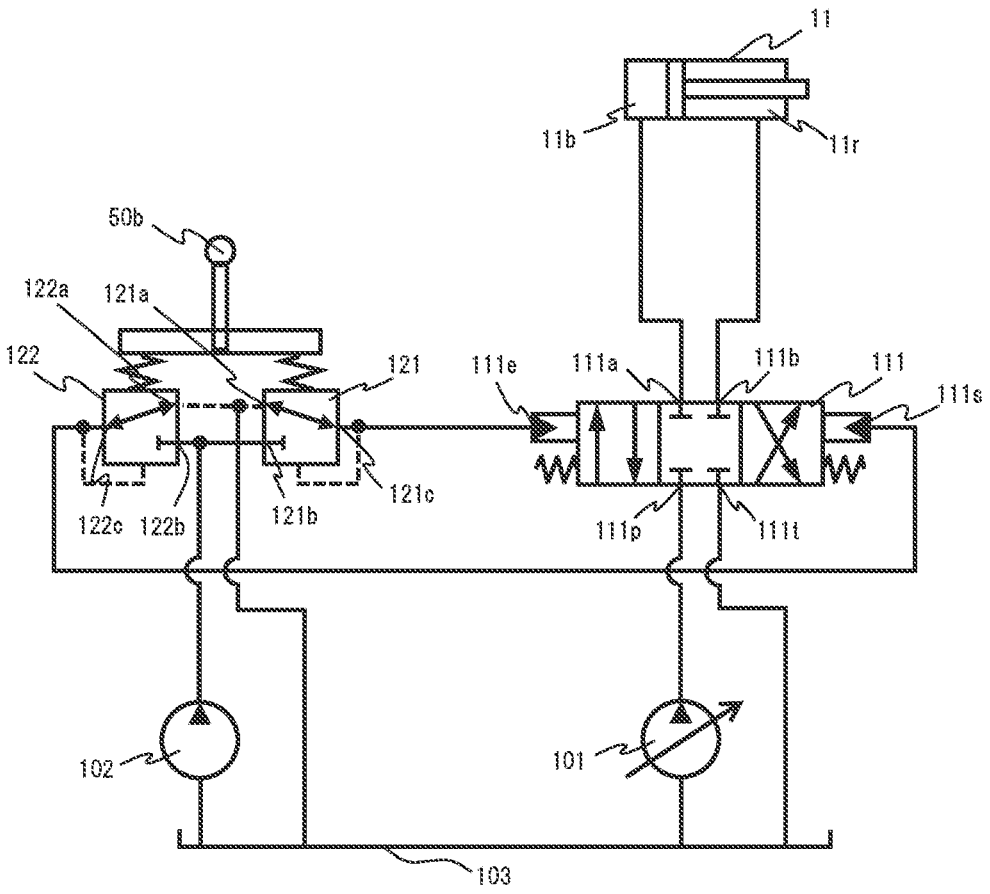
FIG. 2B is a schematic view depicting a configuration of a drive hydraulic circuit for a boom cylinder of a general work machine.

FIG. 2B depicts a schematic view depicting a configuration of the drive hydraulic circuit for the boom cylinder 11 in a general work machine having an operation device of the hydraulic pilot type.

Referring to FIG. 2B, the hydraulic pilot type operation device for the boom is configured from the boom expansion proportional pressure reducing valve 121, the boom contraction proportional pressure reducing valve 122 and a boom control lever 50*b*. The proportional pressure reducing valves 121 and 122 are each driven by an operation of the boom control lever 50*b* to the expansion side or the contraction side to generate pilot hydraulic fluid of a pressure corresponding to an operation amount of the boom control lever 50*b* from hydraulic fluid delivered from the pilot pump 102.

The boom expansion proportional pressure reducing valve 121 includes a first port 121*a*, a second port 121*b* and a third port 121*c*. The first port 121*a* is connected to a hydraulic fluid tank 103; the second port 121*b* to the pilot pump 102; and the third port 121*c* to a boom expansion side pilot port 111*e* of the boom flow control valve 111. When the boom control lever 50*b* is not operated to the expansion side, a valve passage that communicates the first port 121*a* and the third port 121*c* with each other is fully open while the second port 121*b* is fully closed, and hydraulic fluid from the pilot pump 102 is not supplied to the third port 121*c*. If the boom control lever 50*b* is operated to the expansion side, then a valve passage that communicates the second port 121*b* and the third port 121*c* with each other is driven to open in response to the operation. Consequently, the pilot hydraulic fluid is supplied from the pilot pump 102 to the third port 121*c*, and the hydraulic fluid of a pressure according to the lever operation amount is outputted from the third port 121*c*. If the boom control lever 50*b* is operated in a direction for returning from its operation state to its non-operation state, then the boom expansion proportional pressure reducing valve 121 is driven in a direction in which it closes the valve passage that communicates the second port 121*b* and the third port 121*c* with each other and opens the valve passage that communicates the first port 121*a* and the third port 121*c* with each other. If the boom control lever 50*b* is returned to its non-operation state, then the valve passage that communicates the first port 121*a* and the third port 121*c* with each other is brought into a fully open state. At this time, the hydraulic fluid in the pilot fluid path connected to the third port 121*c* flows along the valve passage that communicates the first port 121*a* and the third port 121*c* with each other and is discharged into the hydraulic fluid tank 103.

Similarly to the boom expansion proportional pressure reducing valve 121, the boom contraction proportional pressure reducing valve 122 includes a first port 122*a*, a second port 122*b* and a third port 122*c*, and the third port 122*c* is connected to a boom contraction side pilot port 111*s* of the boom flow control valve 111. If the boom control lever 50*b* is operated to the contraction side, then the boom contraction proportional pressure reducing valve 122 is driven in place of the boom expansion proportional pressure reducing valve 121, and hydraulic fluid of a pressure according to the lever operation amount is outputted from the third port 122*c* of the boom contraction proportional pressure reducing valve 122. On the other hand, if the boom control lever 50*b* is operated in a direction in which it is returned to its non-operation state from the state in which it is operated to the contraction side, then hydraulic fluid of the pilot line connected to the third port 122*c* of the boom contraction proportional pressure reducing valve 122 flows along the valve passage that communicates the first port 122*a* and the third port 122*c* with each other and is discharged into the hydraulic fluid tank 103.

The boom flow control valve 111 is a three-position selector valve of the pilot type having the boom expansion side pilot port 111*e* and the boom contraction side pilot port 111*s*. The boom expansion proportional pressure reducing valve 121 is connected to the boom expansion side pilot port 111*e* through a boom expansion side pilot line, and the boom contraction proportional pressure reducing valve 122 is connected to the boom contraction side pilot port 111*s* through a boom contraction side pilot line. Meanwhile, the actuator side ports 111*a* and 111*b* of the boom flow control valve 111 are connected to a bottom side hydraulic chamber 11*b* and a rod side hydraulic chamber 11*r* of the boom cylinder 11 through a boom expansion side main hydraulic line and a boom contraction side main hydraulic line, respectively. The boom flow control valve 111 is connected at a pump port 111*p* thereof to the main pump 101 and at a tank port lilt thereof to the hydraulic fluid tank 103.

When no pilot hydraulic fluid is supplied to any of the boom expansion side pilot port 111*e* and the boom contraction side pilot port 111*s* of the boom flow control valve 111, the boom flow control valve 111 assumes a neutral position, in which none of supply of hydraulic fluid to the boom cylinder 11 and discharge of hydraulic fluid from the boom cylinder 11 is performed. If the boom control lever 50*b* is operated to the expansion side and pilot hydraulic fluid is supplied to the boom expansion side pilot port 111*e*, then the boom flow control valve 111 is changed over to its expansion driving position, in which hydraulic fluid from the main pump 101 is supplied into the bottom side hydraulic chamber 11*b* of the boom cylinder 11. Consequently, the boom cylinder 11 is driven to expand. On the other hand, if the boom control lever 50*b* is operated to its contraction side, then pilot hydraulic fluid is supplied to the boom contraction side pilot port 111*s*, and the boom flow control valve 111 is changed over to its contraction driving position, in which hydraulic fluid from the main pump 101 is supplied into the rod side hydraulic chamber 11*r* of the boom cylinder 11. Consequently, the boom cylinder 11 is driven to contract. At this time, the opening area of the boom flow control valve 111 is determined by the pressure of the pilot hydraulic fluid supplied to the pilot ports 111*e* and 111*s*, and the boom cylinder 11 is driven to expand and contract at a speed according to the pressure of the pilot hydraulic fluid.

<Drive Control System>

Figure 3A:
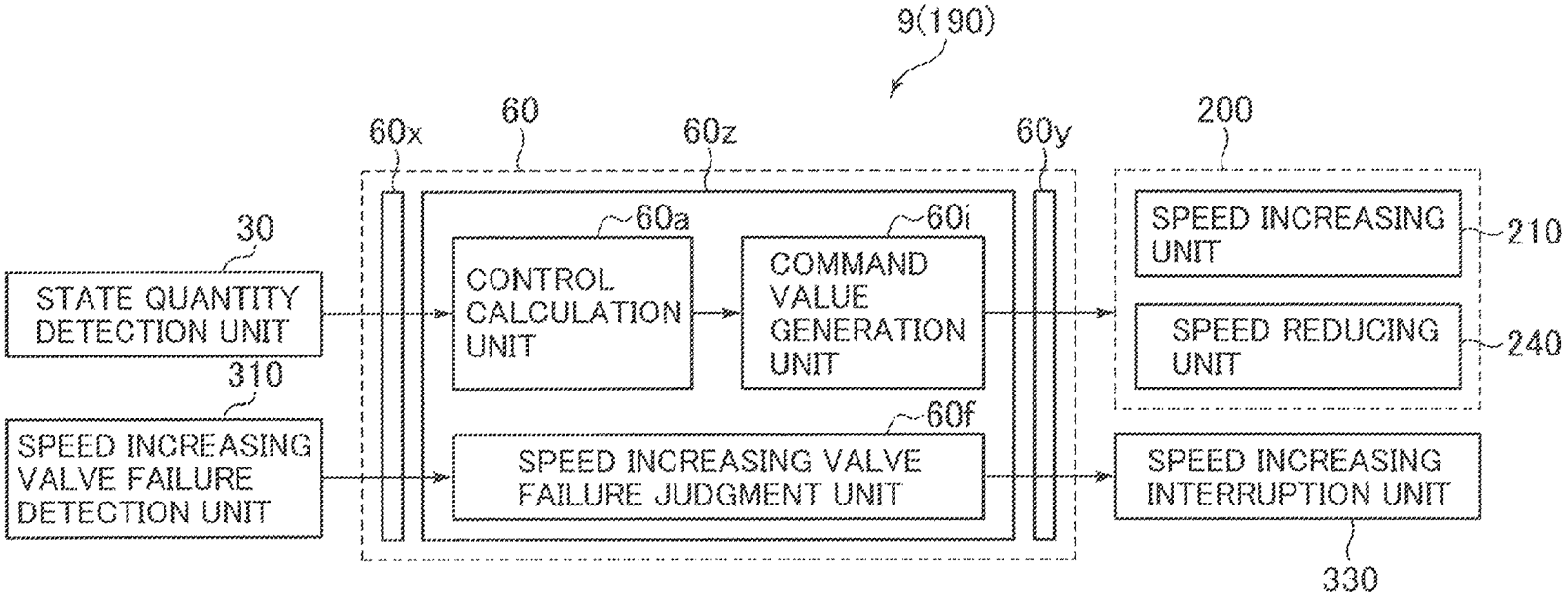
FIG. 3A is a block diagram of a drive control system for a work machine according to the first embodiment in which a stabilization control unit is incorporated.

FIG. 3A is a view depicting a general configuration of the drive control system 9 for a work machine according to the present invention in which a stabilization control unit is incorporated.

As depicted in FIG. 3A, the drive control system 9 for a work machine according to the present embodiment includes, in order to apply various control schemes to the drive actuators 7, 11, 13, 15, . . . , a calculation device 60, a pilot pressure correction unit 200, a speed increasing valve failure detection unit 310 and a speed increase interruption unit 330 in addition to the drive hydraulic circuit 100A for the drive actuators 7, 11, 13, 15, . . . . The drive control system 9 further includes a state quantity detection unit 30 for detecting a state quantity of the work machine 1 required for a control calculation and so forth. The state quantity detection unit 30 includes, for example, an angle sensor for measuring an attitude of the front work implement, a pressure sensor for detecting an operation amount of each control lever 50 (hereinafter described).

The pilot pressure correction unit 200 is configured from a speed increasing unit 210 and a speed reducing unit 240 and is provided on a pilot line that connects the proportional pressure reducing valve set 120 and the flow control valve set 110 depicted in FIG. 2A to each other. By driving the pilot pressure correction unit 200 on the basis of a result of a control calculation from the calculation device 60, the pressure of pilot hydraulic fluid to be outputted from the proportional pressure reducing valve set 120 in response to a lever operation of the operator is corrected thereby to implement control intervention. Further, a failure of the speed increasing unit 210 configuring the pilot pressure correction unit 200 is detected by the speed increasing valve failure detection unit 310, and if a failure occurs with the speed increasing unit 210, then the speed increase interruption unit 330 is rendered operative to invalidate the speed increasing function. This prevents, when the speed increasing unit 210 fails, any associated drive actuator from performing an unintended operation.

As hereinafter described, in the present embodiment, a stabilization control system 190 for preventing destabilization of the work machine 1 during work is incorporated in the work machine 1. The stabilization control system 190 is a system that limits the operation of the drive actuators on the basis of stability evaluation such that, even if an unreasonable operation or an incorrect operation is performed, the work machine 1 may not be destabilized. Preferably, the stabilization control system 190 is configured such that it performs operation limitation for all drive actuators provided on the work machine 1. However, in the following, an actuator drive hydraulic circuit is described taking a case in which the stabilization control system 190 is configured such that operation limitation is applied only to the boom cylinder 11 and the arm cylinder 13, which have an especially significant influence on the stability of the work machine 1 as an example.

<Drive Hydraulic Circuit of Drive Actuator>

Figure 4A:
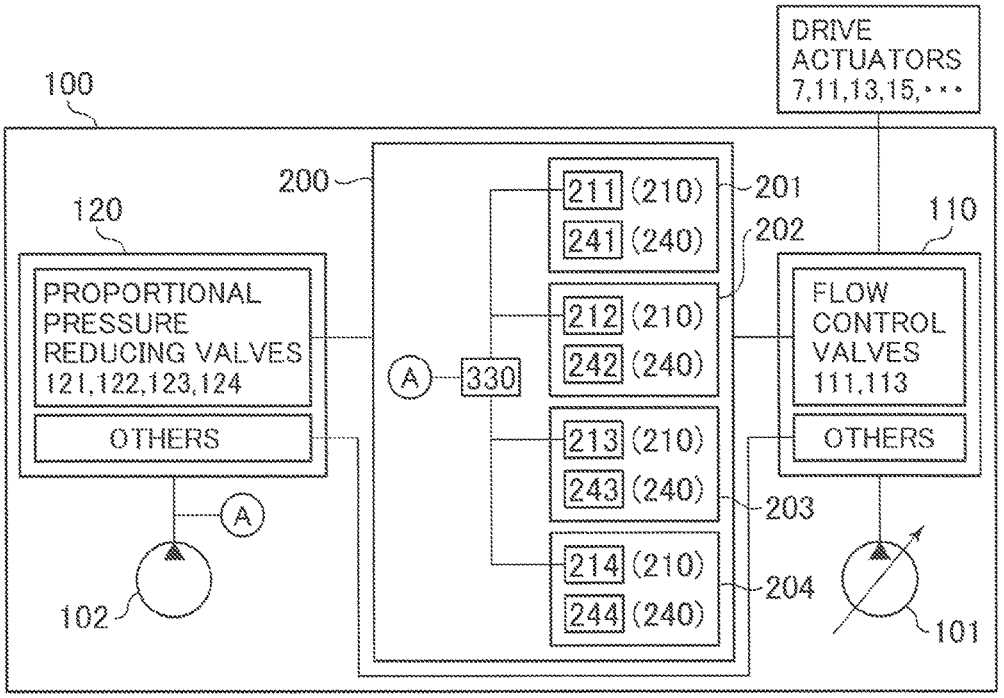
FIG. 4A is a block diagram of an entire drive hydraulic circuit in the drive control system for a work machine according to the first embodiment.

FIG. 4A is a schematic view depicting the entire drive hydraulic circuit 100 for a work machine according to the present embodiment.

Referring to FIG. 4A, the pilot pressure correction unit 200 is a hydraulic unit that corrects the pressure of pilot hydraulic fluid to be outputted from the proportional pressure reducing valve set 120 in response to a lever operation by the operator in accordance with a command from the calculation device 60. The pilot pressure correction unit 200 is provided in a pilot line that connects the proportional pressure reducing valve set 120 and the flow control valve set 110 to each other. In the following direction, the pilot hydraulic fluid outputted from the proportional pressure reducing valve set 120 in response to a lever operation is referred to as lever operation pilot hydraulic fluid; the pressure of the lever operation pilot hydraulic fluid as lever operation pilot pressure; the pilot hydraulic fluid corrected by the pilot pressure correction unit 200 as corrected pilot hydraulic fluid; the pressure of the corrected pilot hydraulic fluid as corrected pilot pressure; and a desired pilot pressure calculated by the calculation device 60 as control command pilot pressure.

To provide the pilot pressure correction unit 200, it is necessary to use a configuration that does not impair the conventional operability. To maintain the conventional operability, it is desirable to use such a configuration that, when there is no requirement for correction, lever operation pilot hydraulic fluid outputted from the proportional pressure reducing valve set 120 is supplied to the flow control valve set 110 similarly as in the case in which the pilot pressure correction unit 200 is not provided, but only when correction is required, the lever operation pilot pressure is corrected. Therefore, in the present embodiment, the pilot pressure correction unit 200 is configured such that, while the conventional pilot hydraulic fluid supply circuit that uses the proportional pressure reducing valve set 120 is taken advantage of, only when it is judged by a control calculation that correction of the lever operation pilot pressure is required, correction is performed.

It is necessary to correct the pilot pressure on the basis of a result of a control calculation in one of a case in which the speed of an operation arising from a lever operation is to be decreased and another case in which the speed is to be increased. Generally, the work machine 1 having the actuator drive hydraulic circuit 100 described above has a characteristic that increase of the pilot pressure increases the speed of operation and decrease of the pilot pressure decreases the operation speed. Accordingly, the pilot pressure correction unit 200 includes the speed increasing unit 210 for generating pilot hydraulic fluid of a pressure higher than the lever operation pilot pressure and the speed reducing unit 240 for decreasing the lever operation pilot pressure.

To perform control intervention in the operation of the boom cylinder 11, as the pilot pressure correction unit 200, a boom expansion pilot pressure correction unit 201 and a boom contraction pilot pressure correction unit 202 are provided in respective pilot lines. Meanwhile, as the speed increasing unit 210 corresponding to each pilot pressure correction unit, a boom expansion speed increasing unit 211 and a boom contraction speed increasing unit 212, and as the speed reducing unit 240, a boom expansion speed reducing unit 241 and a boom contraction speed reducing unit 242 are provided. Similarly, also in order to perform control intervention for operation limitation in the operation of the arm cylinder 13, as the pilot pressure correction unit 200, an arm expansion pilot pressure correction unit 203 and an arm contraction pilot pressure correction unit 204 are provided in the respective pilot lines. Further, as the speed increasing unit 210 corresponding to each pilot pressure correction unit, an arm expansion speed increasing unit 213 and an arm contraction speed increasing unit 214 are provided, and as the speed reducing unit 240, an arm expansion speed reducing unit 243 and an arm contraction speed reducing unit 244 are provided.

The speed increase interruption unit 330 is provided on the upstream side of the speed increasing unit 210, namely, on a line that connects the pilot pump 102 and the speed increasing unit 210 to each other. If a failure of the speed increasing unit 210 is detected, then the speed increase interruption unit 330 is changed over in accordance with a command from the calculation device 60 and interrupts supply of pilot hydraulic fluid from the pilot pump 102 to the speed increasing unit 210 thereby to invalidate the speed increasing function. As depicted in FIG. 4A, the speed increase interruption unit 330 is provided so as to interrupt supply of pilot hydraulic fluid to all of the boom expansion speed increasing unit 211, boom contraction speed increasing unit 212, arm expansion speed increasing unit 213 and arm contraction speed increasing unit 214 that configure the speed increasing unit 210.

<Pilot Pressure Correction Unit>

Figure 4B:
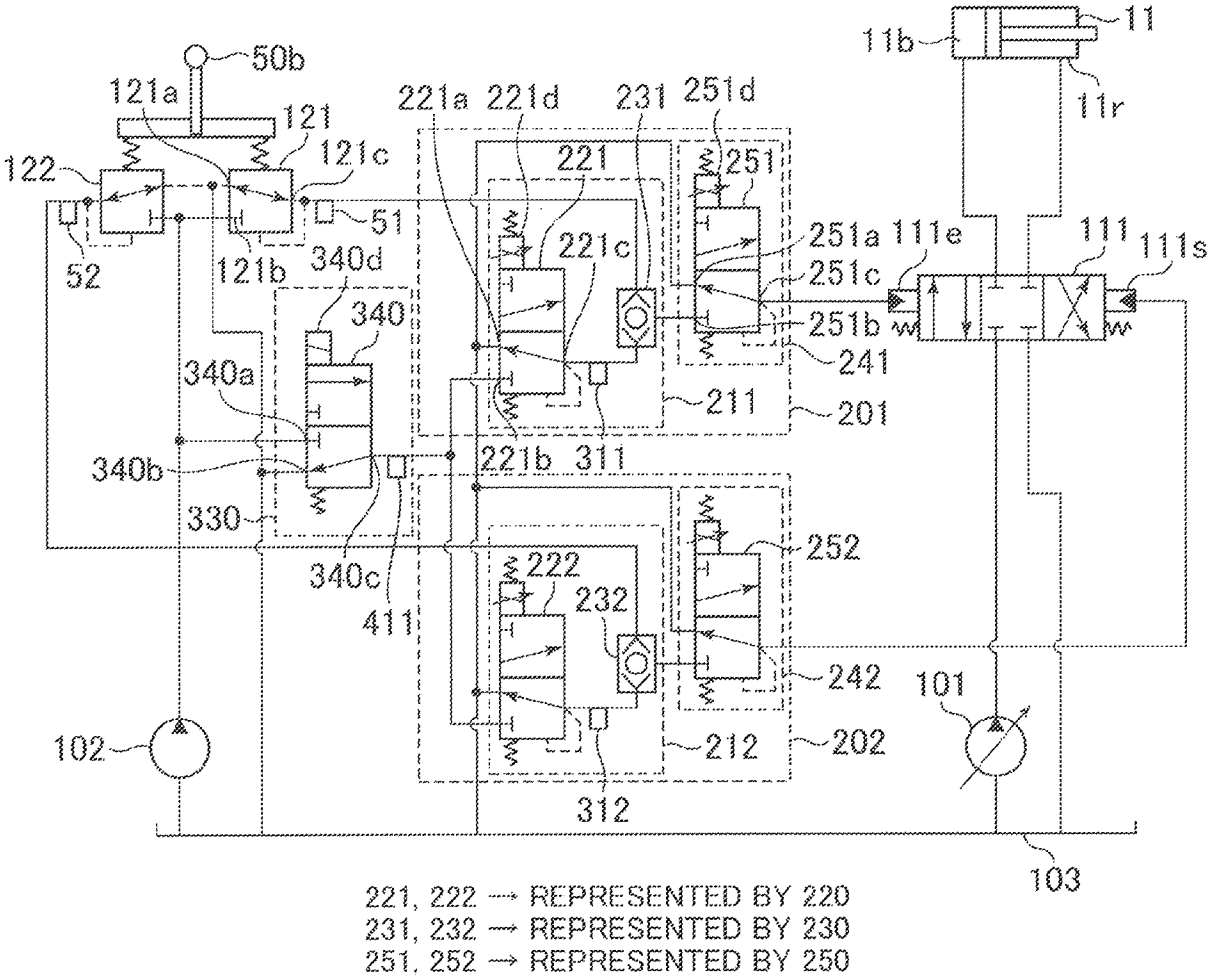
FIG. 4B is a schematic view depicting a configuration of a drive hydraulic circuit for a boom cylinder including a pilot pressure correction unit in the drive control system for a work machine according to the first embodiment.

Since the pilot pressure correction units 201, 202, 203 and 204 have a similar configuration, details of the boom expansion pilot pressure correction unit 201 are described with reference to FIG. 4B taking correction of boom expansion pilot hydraulic fluid as an example. FIG. 4B is a schematic view depicting a configuration of the drive hydraulic circuit for the boom cylinder 11 in the drive control system for a work machine according to the present embodiment.

As described hereinabove, the boom expansion pilot pressure correction unit 201 is configured from the boom expansion speed increasing unit 211 and the boom expansion speed reducing unit 241. Lever operation pilot hydraulic fluid outputted from the boom expansion proportional pressure reducing valve 121 is first inputted to the boom expansion speed increasing unit 211, by which it is subjected to a pressure increasing process on the basis of a control command pilot pressure calculated by the calculation device 60. The pilot hydraulic fluid corrected by the boom expansion speed increasing unit 211 is inputted to the boom expansion speed reducing unit 241, in which it is subjected to a pressure decreasing process on the basis of a control command pilot pressure. The pilot hydraulic fluid corrected by the boom expansion speed reducing unit 241 is inputted to the boom expansion side pilot port 111*e* of the boom flow control valve 111. In the following, details of the boom expansion speed increasing unit 211 and the boom expansion speed reducing unit 241 are described.

<<Speed Increasing Unit>>

The boom expansion speed increasing unit 211 is configured from a speed increasing solenoid proportional valve 221 and a high pressure selection unit (high pressure selection valve) 231. The speed increasing solenoid proportional valve 221 is principally driven in accordance with a command from the calculation device 60 when the control command pilot pressure is higher than the lever operation pilot pressure to generate speed increasing pilot hydraulic fluid from hydraulic fluid delivered from the pilot pump 102. Further, the high pressure selection unit 231 selects a higher pressure one of the lever operation pilot hydraulic fluid and the speed increasing pilot hydraulic fluid and outputs the selected pilot hydraulic fluid.

The speed increasing solenoid proportional valve 221 has a first port 221*a*, a second port 221*b*, a third port 221*c* and a solenoid 221*d*. To the first port 221*a*, the hydraulic fluid tank 103 is connected, and to the second port 221*b*, the pilot pump 102 is connected. If the solenoid 221*d* is excited in accordance with a command signal from the calculation device 60, then speed increasing pilot hydraulic fluid of a pressure according to the command signal is outputted to the third port 221*c*. The speed increasing solenoid proportional valve 221 has such a characteristic of the normally closed type that, when the solenoid 221*d* is not in an excited state, the valve passage that communicates the first port 221*a* and the third port 221*c* with each other is fully open and the second port 221*b* is fully closed such that supply of hydraulic fluid from the pilot pump 102 to the third port 221*c* side is interrupted. Accordingly, when the solenoid 221*d* is in a non-excited state, the pressure on the third port 221*c* side is equal to the tank pressure. If the solenoid 221*d* is excited in accordance with a command signal from the calculation device 60, then the speed increasing solenoid proportional valve 221 is driven in a direction in which it opens the valve passage that communicates the second port 221*b* and the third port 221*c* with each other, and hydraulic fluid from the pilot pump 102 is outputted to the third port 221*c*. The speed increasing solenoid proportional valve 221 has such a characteristic that, as the command signal provided to the solenoid 221*d* increases in magnitude, the pressure of hydraulic fluid outputted from the third port 221*c* increases. The drive command from the calculation device 60 to the solenoid 221*d* is performed on the basis of a control command pilot pressure.

The high pressure selection unit 231 is, for example, a shuttle valve, and lever operation pilot hydraulic fluid outputted from the boom expansion proportional pressure reducing valve 121 and speed increasing pilot hydraulic fluid outputted from the speed increasing solenoid proportional valve 221 are inputted to the high pressure selection unit 231. The high pressure selection unit 231 selects a higher pressure one of the lever operation pilot hydraulic fluid and the speed increasing pilot hydraulic fluid inputted thereto and outputs the selected pilot hydraulic fluid from the speed increasing unit 211. The high pressure selection unit 231 may be a high pressure selection valve of the spool type.

When the control command pilot pressure calculated by the calculation device 60 is higher than the lever operation pilot pressure, the speed increasing pilot pressure outputted from the speed increasing solenoid proportional valve 221 is higher than the lever operation pilot pressure, and the speed increasing pilot pressure is selected by the high pressure selection unit 231. Consequently, control intervention is performed. On the other hand, if the control command pilot pressure is equal to or lower than the lever operation pilot pressure, then the lever operation pilot pressure is higher than the speed increasing pilot pressure. Consequently, the lever operation pilot pressure is selected by the high pressure selection unit 231. Accordingly, in this case, the lever operation pilot hydraulic fluid is outputted without being corrected by the speed increasing unit 211.

<<Speed Reducing Unit>>

In the present embodiment, a speed reducing solenoid proportional valve 251 is provided as the boom expansion speed reducing unit 241. The speed reducing solenoid proportional valve 251 is driven in accordance with a command from the calculation device 60 and decrease the corrected pilot pressure to the control command pilot pressure when the control command pilot pressure is lower than the lever operation pilot pressure.

The speed reducing solenoid proportional valve 251 includes a first port 251*a*, a second port 251*b*, a third port 251*c* and a solenoid 251*d*. To the first port 251*a*, the hydraulic fluid tank 103 is connected; to the second port 251*b*, an output port of the high pressure selection unit 231 is connected; and to the third port 251*c*, the pilot port 111*e* of the boom flow control valve 111 is connected. If the solenoid 251*d* is excited in accordance with a command signal from the calculation device 60, then hydraulic fluid that is decompressed to a pressure according to the command signal is outputted to the third port 251*c*. The hydraulic fluid outputted from the third port 251*c* is corrected pilot hydraulic fluid. The speed reducing solenoid proportional valve 251 has a characteristic of the normally closed type similarly to the speed increasing solenoid proportional valve 221. Accordingly, when the solenoid 251*d* is not excited, the pilot port 111*e* of the boom flow control valve 111 is communicated with the hydraulic fluid tank 103, and the corrected pilot pressure becomes equal to the tank pressure. On the other hand, if the solenoid 251*d* is excited in accordance with a command signal from the calculation device 60, then the speed reducing solenoid proportional valve 251 is driven in a direction in which it opens a valve passage that communicates the second port 251*b* and the third port 251*c* with each other, and pilot hydraulic fluid supplied from the boom expansion speed increasing unit 211 to the second port 251*b* is outputted to the third port 251*c*. The pressure of the hydraulic fluid that flows along the valve passage that communicates the second port 251*b* and the third port 251*c* with each other is determined in accordance with the magnitude of the command signal provided to the solenoid 251*d*. Here, what is determined in accordance with the command signal is an upper limit value of flowing hydraulic fluid, and the corrected pilot pressure is a lower one of the pressure of hydraulic fluid supplied to the second port 251*b* and the upper limit value determined in accordance with a command signal provided to the solenoid 251*d*. Further, if a maximum command signal is provided to the solenoid 251*d*, then the valve passage that communicates the second port 251*b* and the third port 251*c* with each other is fully open. Consequently, the corrected pilot pressure becomes equal to the output pressure of the speed increasing unit 211 irrespective of the pressure of the hydraulic fluid supplied to the second port 251*b*. The drive command from the calculation device 60 to the solenoid 251*d* is performed on the basis of the control command pilot pressure.

When the control command pilot pressure calculated by the calculation device 60 is lower than the output value of the speed increasing unit 211, the pilot hydraulic fluid is decompressed by the speed reducing solenoid proportional valve 251 thereby to implement the commanded control intervention. On the other hand, if the output pressure of the speed increasing unit 211 is lower than the control command pilot pressure, then the pilot hydraulic fluid is not corrected by the speed reducing solenoid proportional valve 251, and the pilot hydraulic fluid outputted from the speed increasing unit 211 is supplied to the pilot port 111*e* of the boom flow control valve 111.

As described above, the speed increasing unit 211 in the present embodiment outputs speed increasing pilot hydraulic fluid generated by the speed increasing solenoid proportional valve 221 only when the control command pilot value is higher than the lever operation pilot pressure and it is required to increase the pilot pressure. However, when there is no requirement to increase the pilot pressure, the speed increasing unit 211 outputs lever operation pilot hydraulic fluid outputted from the proportional pressure reducing valve 121 similarly to the conventional pilot hydraulic fluid supply circuit. Further, only when the control command pilot pressure is lower than the lever operation pilot pressure and it is required to decrease the pilot pressure, the speed reducing unit 241 decompresses the pilot hydraulic fluid by the speed reducing solenoid proportional valve 251, but when there is no requirement to decompress the pilot hydraulic fluid to decrease the pilot pressure, the speed reducing unit 241 outputs the pilot hydraulic fluid supplied from the speed increasing unit 211 as it is. In short, when the lever operation pilot pressure and the control command pilot pressure are equal to each other and there is no requirement for control intervention, the lever operation pilot hydraulic fluid is not corrected by any of the speed increasing unit 211 and the speed reducing unit 241, and the lever operation pilot hydraulic fluid outputted from the proportional pressure reducing valve 121 is supplied to the pilot port 111*e* of the boom flow control valve 111 similarly as in the conventional pilot hydraulic fluid supply circuit. By using a configuration that takes advantage of the conventional pilot hydraulic fluid supply circuit, control intervention can be performed without having an influence on the conventional operability.

Also the boom contraction pilot pressure correction unit 202 has a configuration similar to that of the boom expansion pilot pressure correction unit 201, and in the present embodiment, includes the boom expansion speed increasing solenoid proportional valve 221 and a boom contraction speed increasing solenoid proportional valve 222 as speed increasing solenoid proportional valves. Further, the boom contraction pilot pressure correction unit 202 includes the boom expansion high pressure selection unit 231 and a boom contraction high pressure selection unit 232 as high pressure selection units, and includes the boom expansion speed reducing solenoid proportional valve 251 and a boom contraction speed reducing solenoid proportional valve 252 as speed reducing solenoid proportional valves.

<Risk by Solenoid Proportional Valve Failure>

Where the pilot pressure correction unit 200 described above is used, the pilot pressure can be collected to a control command pilot pressure calculated by the calculation device 60. On the other hand, where a solenoid proportional valve is provided for correction of the pilot pressure, there is the possibility that a failure may occur with the drive circuit for a solenoid proportional valve or, if a solenoid proportional valve sticks as a result of biting of a foreign article such as refuse, then the output pressure may not become equal to the output commanded from the calculation device 60 and pilot hydraulic fluid of an unintended pressure may be supplied to the flow control valve set 110. For example, even if such a drive command as to decrease the output pressure to zero is issued from the calculation device 60 to a solenoid proportional valve, there is the possibility that the output pressure may not become zero and the drive actuator may not be stopped.

Especially, since a speed increasing solenoid proportional valve 220 (representing the boom expansion speed increasing solenoid proportional valve 221 and the boom contraction speed increasing solenoid proportional valve 222) is configured such that it decompresses pilot hydraulic fluid delivered from the pilot pump 102 and outputs the decompressed pilot hydraulic fluid, if the speed increasing solenoid proportional valve 220 suffers from a failure, then there is the pressure that hydraulic fluid of a fixed pressure may continue to be outputted irrespective of a command from the calculation device 60 and the drive actuator may continue an intended operation, resulting in failure to stop.

On the other hand, if a failure occurs with a speed reducing solenoid proportional valve 250 (representing the boom expansion speed reducing solenoid proportional valve 251 and the boom contraction speed reducing solenoid proportional valve 252), then decompression of the pilot hydraulic fluid, namely, reduction of the speed, cannot be performed by the command from the calculation device 60. However, since the speed reducing solenoid proportional valve 250 is configured such that it decompresses and outputs the pilot hydraulic fluid outputted from the speed increasing unit 210, even if a failure occurs with the speed reducing solenoid proportional valve 250, if the speed increasing solenoid proportional valve 220 does not suffer from a failure, it is possible to stop the drive actuator by returning the control lever 50 to its neutral position. Further, if a solenoid proportional valve having a characteristic of the normally closed type which interrupts supply of hydraulic fluid when a control command from the calculation device is not received is used as the speed reducing solenoid proportional valve 250 as described above, then even if a failure occurs with the drive circuit for the solenoid proportional valve, the drive actuator can be kept in the stopping state.

In the present embodiment, the speed increasing solenoid proportional valve 220 especially having a high risk of failure is monitored against a failure, and if a failure should occur with the speed increasing solenoid proportional valve 220, then supply of pilot hydraulic fluid to the speed increasing solenoid proportional valve 220 is interrupted to invalidate the speed increasing function thereby to avoid such a situation that the drive actuator continues the unintended operation and is disabled from stopping. On the other hand, with regard to a failure of the speed reducing solenoid proportional valve 250, since there is no possibility in that the drive actuator may be disabled from stopping even if such a failure as described above occurs, supply of pilot hydraulic fluid by a lever operation is performed without performing such a process as to interrupt the pilot hydraulic fluid or the like. Consequently, it is possible to avoid malfunction of an actuator when an associated solenoid proportional valve fails by a simple configuration and enable, even when the solenoid proportional valve fails, driving of the work machine by a lever operation to continue the work.

<Speed Increasing Valve Failure Detection Unit>

In the present embodiment, as the speed increasing valve failure detection unit 310 that detects a failure of the speed increasing solenoid proportional valve 220, a pressure sensor is provided in a hydraulic line that connects the speed increasing solenoid proportional valve 220 that configures the speed increasing unit 210 and a high pressure selection unit 230 (representing the boom expansion high pressure selection unit 231 and the boom contraction high pressure selection unit 232) to each other. If the speed increasing solenoid proportional valve 220 is in failure, then the pressure of hydraulic fluid outputted from the speed increasing solenoid proportional valve 220 is displaced from the pressure commanded from the calculation device 60. Accordingly, a failure of the speed increasing solenoid proportional valve 220 can be detected by monitoring the output pressure of the speed increasing solenoid proportional valve 220, namely, the pressure at the speed increasing solenoid proportional valve 220 on the third port 220*c* side.

The work machine 1 in the present embodiment includes, as the speed increasing solenoid proportional valves 220, the boom expansion speed increasing solenoid proportional valve 221 and the boom contraction speed increasing solenoid proportional valve 222. To detect a failure of each of the speed increasing solenoid proportional valve, a boom expansion speed increasing pressure sensor 311 is provided in a hydraulic line that connects the boom expansion speed increasing solenoid proportional valve 221 and the boom expansion high pressure selection unit 231, and a boom contraction speed increasing pressure sensor 312 is provided in another line that connects the boom contraction speed increasing solenoid proportional valve 222 and the boom contraction high pressure selection unit 232. Detection signals of the pressure sensors 311 and 312 are inputted to the calculation device 60 and are used for failure judgment of the speed increasing solenoid proportional valves 221 and 222 by a speed increasing valve failure judgment unit 60*f* hereinafter described in the calculation device 60.

<Speed Increase Interruption Unit>

In the present embodiment, the speed increase interruption unit 330 for invalidating the speed increasing function is provided in order to prevent such a situation that, when a failure occurs with the speed increasing solenoid proportional valve 220, the drive actuator continues the unintended operation and is disabled from stopping. Further, in the present embodiment, as the speed increase interruption unit 330, a speed increase interruption solenoid selector valve 340 is provided on the upstream side of the speed increasing solenoid proportional valve 220, namely, in a hydraulic line that connects the pilot pump 102 and the speed increasing solenoid proportional valve 220 to each other. The speed increase interruption solenoid selector valve 340 is a solenoid selector valve that is changed over in accordance with a command from the calculation device 60 to interrupt supply of pilot hydraulic fluid from the pilot pump 102 to the speed increasing solenoid proportional valve 220.

In the present embodiment, as speed increasing units for boom expansion and boom contraction, the boom expansion speed increasing solenoid proportional valve 221 and the boom contraction speed increasing solenoid proportional valve 222 are provided, respectively, and pilot hydraulic fluid from the pilot pump 102 is supplied to the second ports of the speed increasing solenoid proportional valves 221 and 222. The speed increase interruption solenoid selector valve 340 is provided so as to interrupt supply of pilot hydraulic fluid to all of the speed increasing solenoid proportional valves 221 and 222, . . . as depicted in FIGS. 4A and 4B.

The speed increase interruption solenoid selector valve 340 is a solenoid selector valve including a first port 340*a*, a second port 340*b*, a third port 340*c* and a solenoid 340*d*. To the first port 340*a*, the pilot pump 102 is connected, and to the second port 340*b*, the hydraulic fluid tank 103 is connected. When the solenoid 340*d* is not excited, the second port 340*b* and the third port 340*c* are communicated with each other, and if the solenoid 340*d* is excited, then the first port 340*a* and the third port 340*c* are communicated with each other. Accordingly, in a state in which the solenoid 340*d* is excited, a supply state in which pilot hydraulic fluid from the pilot pump 102 is outputted from the third port 340*c* is established, and in another state in which the solenoid 340*d* is not excited, an interruption state in which supply of pilot hydraulic fluid from the pilot pump 102 to the third port 340*c* side is interrupted is established. The third port 340*c* of the speed increase interruption solenoid selector valve 340 is connected to a hydraulic line that is connected to the second ports of all of the speed increasing solenoid proportional valves 221 and 222, . . . . Accordingly, if the solenoid 340*d* is placed into a non-excited state in accordance with a command from the calculation device 60, then supply of pilot hydraulic fluid to all speed increasing solenoid proportional valves 221 and 222 can be interrupted. In the following, an action of the speed increase interruption unit 330 is described taking the boom expansion speed increasing unit 211 as an example.

If the solenoid 340*d* of the speed increase interruption solenoid selector valve 340 is placed into an excited state to establish a state in which hydraulic fluid from the pilot pump 102 is supplied to the speed increasing solenoid proportional valve 221, then a construction same as the configuration that does not include the speed increase interruption solenoid selector valve 340 is obtained. In particular, the speed increasing solenoid proportional valve 221 generates a speed increasing pilot pressure from pilot hydraulic fluid delivered from the pilot pump 102, and the high pressure selection unit 231 selects a higher pressure one of the speed increasing pilot hydraulic fluid and the lever operation pilot hydraulic fluid. On the other hand, if the solenoid 340*d* of the speed increase interruption solenoid selector valve 340 is placed into a non-excited state to interrupt supply of hydraulic fluid from the pilot pump 102 to the speed increasing solenoid proportional valve 221, then the third port 221*c* side pressure of the speed increasing solenoid proportional valve 221 becomes equal to the tank pressure irrespective of the state of the speed increasing solenoid proportional valve 221, and the high pressure selection unit 231 always selects the lever operation pilot pressure. Accordingly, by placing the speed increase interruption solenoid selector valve 340 into an interruption state, such a situation that hydraulic fluid of a pressure different from a command pressure continues to be outputted from the speed increasing solenoid proportional valve 221 and the boom cylinder 11 is disabled from stopping can be avoided. Further also when the speed increase interruption solenoid selector valve 340 is placed into an interruption state, supply of pilot hydraulic fluid to the boom expansion proportional pressure reducing valve 121 continues, and lever operation pilot pressure according to a lever operation is outputted from the speed increasing unit 211. Therefore, the boom cylinder 11 can be moved by an operation of the boom control lever 50*b*. In other words, while the boom cylinder 11 is prevented from performing an unintended operation because of a failure of the speed increasing solenoid proportional valve 221, driving by a lever operation is enabled, and therefore, the work can be continued and the convenience can be kept high.

As described above, the speed increase interruption solenoid selector valve 340 is disposed such that it interrupts supply of pilot hydraulic fluid to all speed increasing solenoid proportional valves, and if the speed increase interruption solenoid selector valve 340 is placed into an interruption state, then also in the boom contraction speed increasing unit 212, supply of pilot hydraulic fluid from the pilot pump 102 is interrupted and a lever operation pilot pressure is outputted similarly as in the case of the boom expansion speed increasing unit 211. Where such a configuration as described above is adopted, even if a plurality of pilot pressure correction units are provided, only it is necessary to provide one speed increase interruption solenoid selector valve 340. Therefore, an unintended operation of the drive actuator by a failure of the speed increasing solenoid proportional valve 220 can be prevented by a simple and easy configuration.

<Calculation Device>

Referring back to FIG. 3A, the calculation device 60 is configured from a CPU, a storage section configured from a ROM (Read only Memory), a RAM (Random Access Memory), a flash memory and so forth, a microcomputer including them, peripheral circuits not depicted and so forth. The calculation device 60 operates in accordance with a program stored, for example, in the ROM.

The calculation device 60 includes an input unit 60*x*, a calculation unit 60*z* and an output unit 60*y*. To the input unit 60*x*, a signal is inputted from the state quantity detection unit 30, speed increasing valve failure detection unit 310 or the like. The calculation unit 60*z* receives a signal inputted to the input unit 60*x* and performs a predetermined calculation. The output unit 60*y* receives an output signal from the calculation unit 60*z* and outputs a drive command to the pilot pressure correction unit 200 and the speed increase interruption unit 330.

<Calculation Unit>

The calculation unit 60*z* is configured from a control calculation unit 60*a*, a command value generation unit 60*i*, and a speed increasing valve failure judgment unit 60*f*. The control calculation unit 60*a* performs a predetermined control calculation in response to a signal fetched from the state quantity detection unit 30 to calculate a control command pilot pressure. The command value generation unit 60*i* calculates a drive command value to the pilot pressure correction unit 200 on the basis of an output from the control calculation unit 60*a*. The speed increasing valve failure judgment unit 60*f* judges a failure of the speed increasing solenoid proportional valve 220 included in the speed increasing unit 210 of the pilot pressure correction unit 200 on the basis of a signal fetched from the speed increasing valve failure detection unit 310 to determine a drive command value to the speed increase interruption unit 330.

<Control Calculation Unit>

The control calculation unit 60*a* functions as a stabilization control calculation unit, and evaluates stability of the work machine 1 on the basis of a result of detection of the state quantity detection unit 30, judges whether or not operation limitation is required on the basis of a result of the stability evaluation and calculates, when operation limitation is required, a control command pilot pressure. Details of the stabilization control calculation unit are described later.

<Part 1 of Command Value Generation Unit>

The command value generation unit 60*i* calculates a drive command value of the pilot pressure correction unit 200 on the basis of a control command pilot pressure outputted from the control calculation unit 60*a* and outputs the drive command value to the output unit 60*y* of the calculation device 60.

In the present embodiment, the pilot pressure correction units 201 and 202 are provided in order to perform correction of pilot pressures for boom expansion and boom contraction. A command value generation unit 60*i* calculates drive command values for the speed increasing solenoid proportional valves 221 and 222 and the speed reducing solenoid proportional valves 251 and 252 that configure the pilot pressure correction units 201 and 202, respectively. Since the calculation method of a drive command value is similar for all of the pilot pressure correction units, in the following, a calculation method of drive command values for the boom expansion speed increasing solenoid proportional valve 221 and the boom expansion speed reducing solenoid proportional valve 251 is described taking correction of boom expansion pilot hydraulic fluid as an example.

Figure 5A:
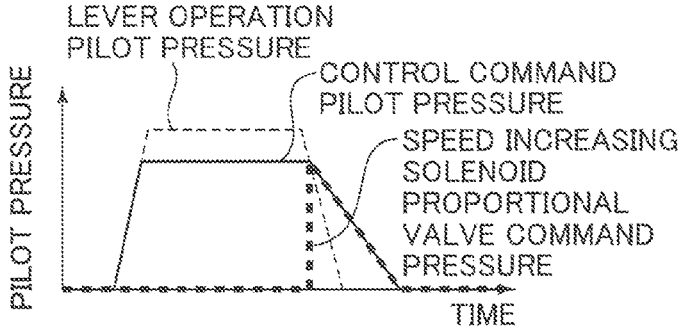
FIG. 5A is a view illustrating an example of pilot pressure correction by a speed increasing solenoid proportional valve according to the first embodiment.
Figure 5B:
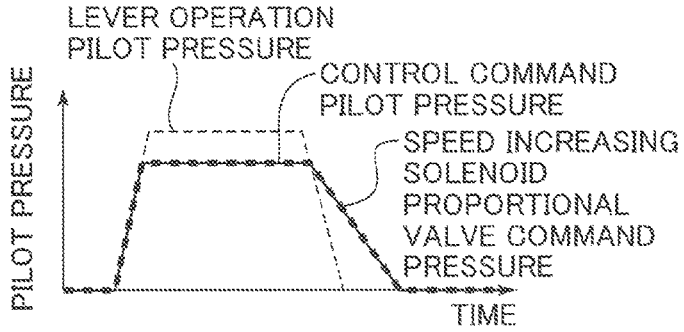
FIG. 5B is a view illustrating an example of pilot pressure correction by a speed increasing solenoid proportional valve according to a modification to the first embodiment.

As described hereinabove, when the control command pilot pressure is higher than the lever operation pilot pressure, the speed increasing solenoid proportional valve 221 decompresses hydraulic fluid delivered from the pilot pump 102 to generate pilot hydraulic fluid of the control command pilot pressure. Accordingly, the speed increasing solenoid proportional valve command pressure is determined in such a manner as illustrated in FIG. 5A. In particular, when the control command pilot pressure is higher than the lever operation pilot pressure, the control command pilot pressure is determined as the speed increasing solenoid proportional valve command pressure, but when the control command pilot pressure is equal to or lower than the lever operation pilot pressure, the speed increasing solenoid proportional valve command pressure is determined to be zero. The pressure of hydraulic fluid to be outputted from the speed increasing solenoid proportional valve 221 is determined based on the magnitude of the command signal provided to the solenoid 221*d*, and the relationship between the command signal and the pressure is given as an output characteristic of the valve in such a manner as, for example, illustrated in FIG. 5C. As a result, the drive command value to the speed increasing solenoid proportional valve 221 is determined in such a manner as depicted in FIG. 5D using the speed increasing solenoid proportional valve command pressure and the output characteristic of the speed increasing solenoid proportional valve 221.

Figure 6A:
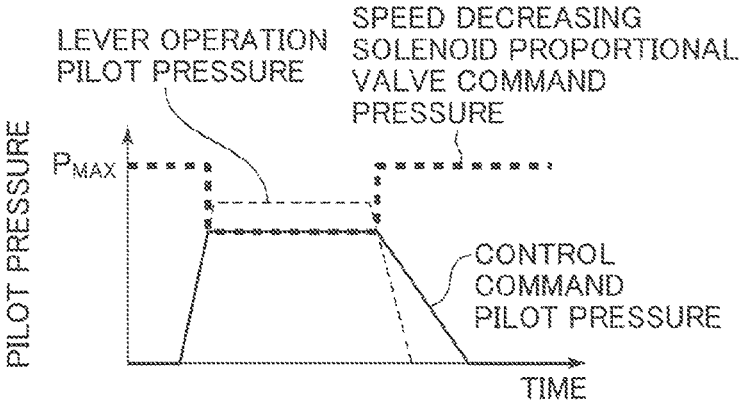
FIG. 6A is a view illustrating an example of pilot pressure correction for a speed reducing solenoid proportional valve according to the first embodiment.
Figure 6B:
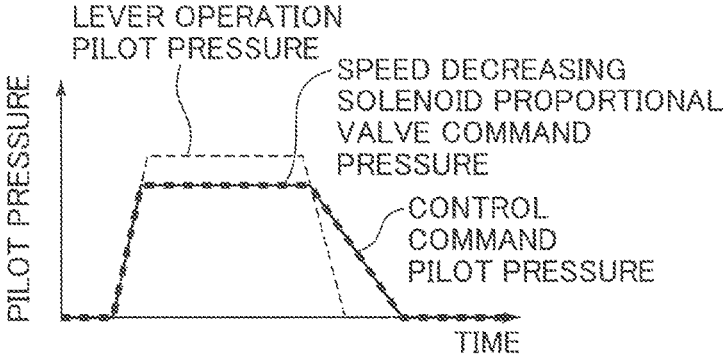
FIG. 6B is a view illustrating an example of pilot pressure correction for a speed reducing solenoid proportional valve according to a modification to the first embodiment.

The speed reducing solenoid proportional valve 251 is used to reduce the pilot pressure to a control command pilot pressure when the control command pilot pressure is lower than the lever operation pilot pressure. Accordingly, the speed reducing solenoid proportional valve command pressure is determined in such a manner as, for example, illustrated in FIG. 6A. In particular, when the control command pilot pressure is equal to or lower than the lever operation pilot pressure, the control command pilot pressure is determined as the speed reducing solenoid proportional valve command pressure, but in any other case, a maximum set pressure of the speed reducing solenoid proportional valve 251 is determined as the speed reducing solenoid proportional valve command pressure. The pressure of hydraulic fluid to be outputted from the speed reducing solenoid proportional valve 251 is determined based on the magnitude of the command signal provided to the solenoid 251*d*, and the relationship between the command signal and the pressure is given as an output characteristic of the valve in such a manner as, for example, illustrated in FIG. 6C. The drive command value to the speed reducing solenoid proportional valve 251 is determined in such a manner as depicted in FIG. 6D using the speed reducing solenoid proportional valve command pressure described hereinabove and the output characteristic of the speed reducing solenoid proportional valve 251.

<Speed Increasing Valve Failure Judgment Unit>

The speed increasing valve failure judgment unit 60*f* judges whether or not the speed increasing solenoid proportional valve 220 suffers from a failure by comparing detection values of the speed increasing pressure sensors 311 and 312 configuring the speed increasing valve failure detection unit 310 and the speed increasing solenoid proportional valve command pressure calculated by the command value generation unit 60*i* with each other. If the speed increasing solenoid proportional valve 220 suffers from a failure, then pilot hydraulic fluid of a pressure different from the speed increasing solenoid proportional valve command pressure is outputted from the speed increasing solenoid proportional valve 220. Therefore, the speed increasing valve failure judgment unit 60*f* calculates a difference between the speed increasing solenoid proportional valve command pressure and a detection value of the speed increasing pressure sensor. Then, if the difference is within a predetermined value, then the speed increasing valve failure judgment unit 60*f* judges that the speed increasing solenoid proportional valve 220 is "normal," but if the difference is greater than the predetermined value, then the speed increasing valve failure judgment unit 60*f* judges that the speed increasing solenoid proportional valve 220 is a "failure" state.

In the present embodiment, for pilot pressure correction for boom expansion and boom contraction, the speed increasing valve failure judgment unit 60*f* includes the boom expansion speed increasing solenoid proportional valve 221 and the boom contraction speed increasing solenoid proportional valve 222, and performs a failure judgment with regard to the speed increasing solenoid proportional valves. Then, if a failure judgment result is "normal" with regard to both of the speed increasing solenoid proportional valves 221 and 222, then the speed increasing valve failure judgment unit 60*f* instructs the speed increase interruption solenoid selector valve 340 to establish a communication state in which hydraulic fluid can be supplied from the pilot pump 102 to the speed increasing solenoid proportional valves 221 and 222.

On the other hand, if it is judged that at least one of the speed increasing solenoid proportional valves 221 and 222 is in a "failure" state, then the speed increasing valve failure judgment unit 60*f* issues a command to the speed increase interruption solenoid selector valve 340 to establish an interruption state in which it interrupts supply of hydraulic fluid from the pilot pump 102 to all of the speed increasing solenoid proportional valves 221 and 222. As described hereinabove, the speed increase interruption solenoid selector valve 340 in the present embodiment establishes, if the solenoid 340*d* is placed into a non-excited state, an interruption state in which it interrupts supply of hydraulic fluid from the pilot pump 102 but establishes, if the speed increase interruption solenoid selector valve 340 is placed into an excited state, a communication state in which hydraulic fluid from the pilot pump 102 can be supplied. Accordingly, only when the failure detection result of all speed increasing solenoid proportional valves is "normal," the speed increasing valve failure judgment unit 60*f* outputs a command signal to excite the solenoid 340*d* of the speed increase interruption solenoid selector valve 340, but in any other case, the speed increasing valve failure judgment unit 60*f* issues a command to place the solenoid 340*d* of the speed increase interruption solenoid selector valve 340 into a non-excited state.

<Stabilization Control>

The work machine 1 according to the present embodiment incorporates therein the stabilization control system 190 that prevents destabilization of the work machine 1 during work. While the work machine 1 performs various works in response to an operation of a control lever 50 by the operator, the stability of the work machine 1 deteriorates when the work machine 1 performs a work in an attitude in which the front work implement 6 is expanded or when the load applied to the attachment 23 is high. Further, if the operator performs a quick operation, then high inertial force acts on the work machine 1 together with a sudden speed change, and by an influence of the high inertial force, the stability of the work machine 1 varies significantly. Especially, upon such a sudden stoppage operation that a control lever 50 is returned at an instant from its operation state to a stoppage command state, high inertial force acts in the falling direction and the work machine 1 is likely to be destabilized.

The stabilization control system 190 of the present embodiment is a system that limits the operation of the drive actuators on the basis of stability evaluation such that, even if an unreasonable operation or an incorrect operation is performed, the work machine 1 may not be destabilized. Further, the stabilization control system 190 of the present embodiment performs gradual stoppage and operation speed limitation as operation limitation for keeping the work machine 1 stable taking it into consideration that the stability is deteriorated significantly by a sudden stoppage operation.

Here, gradual stoppage is a operation for limiting the deceleration acceleration of a movable part upon a stoppage operation to cause the movable part to stop gradually, and the operation speed limitation is an action to limit the maximum speed of the drive actuators. By introducing the gradual stoppage, the inertial force to be generated upon a sudden stoppage operation can be suppressed, and the work machine 1 can be prevented from being destabilized by high inertial force generated upon sudden stopping. On the other hand, if gradual stoppage is performed, then since the braking distance increases, it is necessary to determine an allowable braking distance in advance and set a stoppage characteristic such that stopping within the allowable braking distance can be achieved. Therefore, the stabilization control system 190 of the present embodiment performs gradual stoppage within an allowable braking distance determined in advance as occasion demands and limits the operation speed such that, in any operation state, stable work can be performed within the allowable braking distance.

<Stabilization Control System>

Figure 3B:
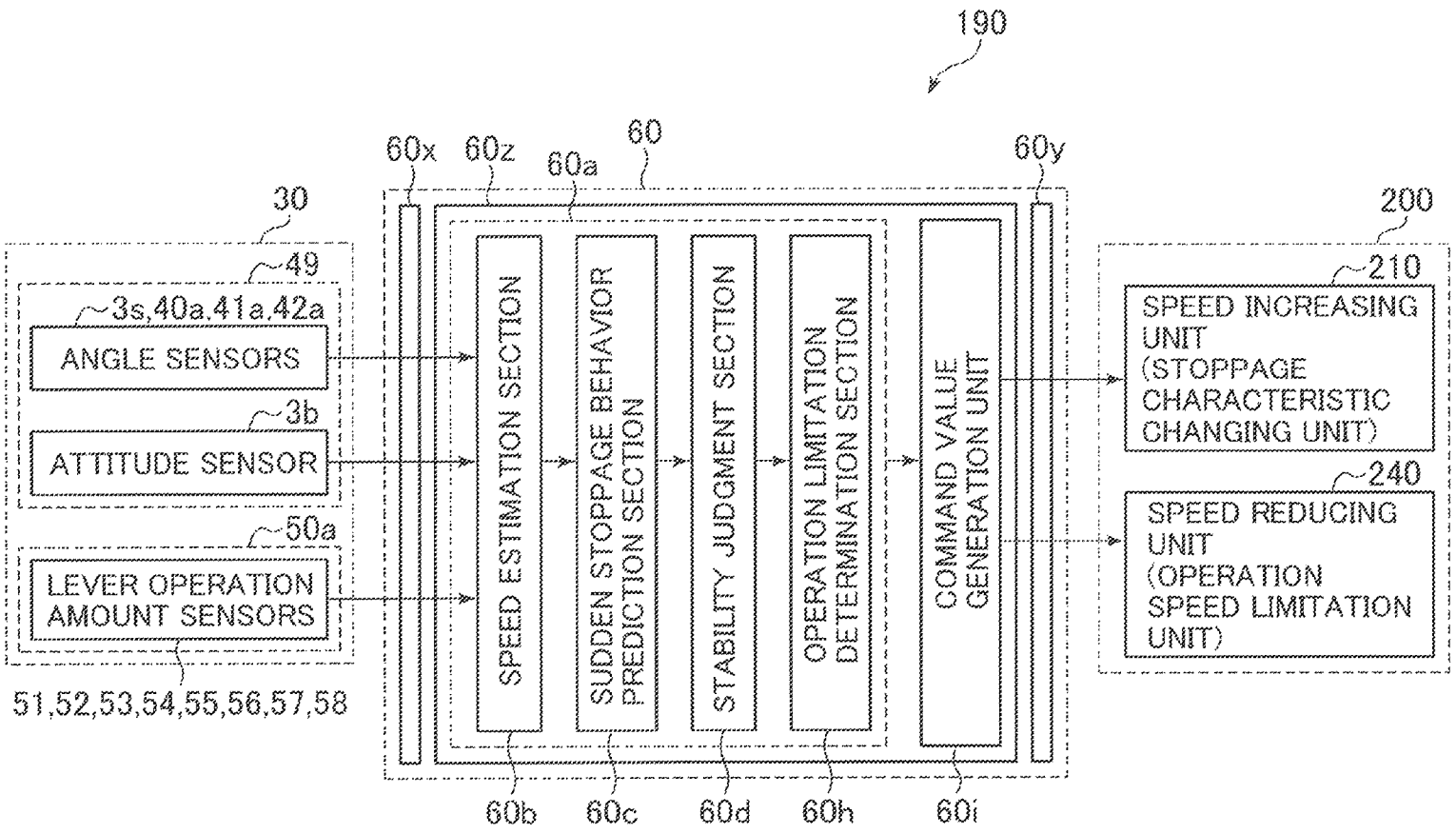
FIG. 3B is a block diagram depicting details of a state quantity detection unit and a control calculation unit (stabilization control unit) depicted in FIG. 3A.

FIG. 3B is a view depicting details of the state quantity detection unit 30 and the control calculation unit 60*a* of the drive control system 9 depicted in FIG. 3A. Details of the stabilization control system 190 are described below with using FIG. 3B.

<State Quantity Detection Unit>

A sensor for detecting a state quantity of the machine is provided as the state quantity detection unit 30 at main portions of the work machine 1. The state quantity detection unit 30 is configured from an attitude detection unit 49 that detects an attitude of the work machine 1, and a lever operation amount detection unit 50*a* that detects an operation command value from the operator to each drive actuator.

The attitude detection unit 49 is a functional block that detects an attitude of the work machine 1 and is configured from an attitude sensor 3*b* and angle sensors 3*s*, 40*a*, 41*a* and 42*a*. As depicted in FIG. 1, the attitude sensor 3*b* for detecting the inclination of the work machine 1 is provided on the swing structure 3. Further, the angle sensor 3*s* for detecting a swing angle of the swing structure 3 with respect to the track structure 2 is provided on the central axis 3*c* of the swing structure 3. A boom angle sensor 40*a* for measuring a rotation angle of the boom 10 is provided at the supporting point 40 of the boom 10 on the swing structure 3. An arm angle sensor 41*a* for measuring a rotation angle of the arm 12 is provided at the supporting point 41 of the arm 12 on the boom 10. An attachment angle sensor 42*a* is provided at the supporting point 42 of the attachment 23 on the arm 12.

The lever operation amount detection unit 50*a* is a functional block that detects an operation command amount from the operator to each drive actuator of the work machine 1 and includes a lever operation amount sensor that detects an operation amount of the control lever 50. In the hydraulic pilot type operation device described above, if a control lever 50 is operated, then a corresponding one of the proportional pressure reducing valves of the proportional pressure reducing valve set 120, and pilot hydraulic fluid of a pressure according to the lever operation amount is outputted. Accordingly, by providing a pressure sensor for detecting a pressure of hydraulic fluid outputted from each proportional pressure reducing valve, an operation command value from the operator can be detected.

More particularly, as depicted in FIG. 4B, a boom expansion operation amount sensor 51 and a boom contraction operation amount sensor 52 are provided. The boom expansion operation amount sensor 51 is a pressure sensor for detecting the pressure of hydraulic fluid outputted from the boom expansion proportional pressure reducing valve 121. The boom contraction operation amount sensor 52 is a pressure sensor for detecting the pressure of hydraulic fluid outputted from the boom contraction proportional pressure reducing valve 122. Similarly, an arm expansion operation amount sensor 53, an arm contraction operation amount sensor 54, an attachment expansion operation amount sensor 55, an attachment contraction operation amount sensor 56, a right swing operation amount sensor 57 and a left swing operation amount sensor 58 are provided. The arm expansion operation amount sensor 53 is a pressure sensor for detecting the pressure of hydraulic fluid outputted from the arm expansion proportional pressure reducing valve 123. The arm contraction operation amount sensor 54 is a pressure sensor for detecting the pressure of hydraulic fluid outputted from the arm contraction proportional pressure reducing valve 124. The attachment expansion operation amount sensor 55 is a pressure sensor for detecting the pressure of hydraulic fluid outputted from the attachment expansion proportional pressure reducing valve 125. The attachment contraction operation amount sensor 56 is a pressure sensor for detecting the pressure of hydraulic fluid outputted from the attachment contraction proportional pressure reducing valve 126. The right swing operation amount sensor 57 is a pressure sensor for detecting the pressure of hydraulic fluid outputted from the right swing proportional pressure reducing valve 127. The left swing operation amount sensor 58 is a pressure sensor for detecting the pressure of hydraulic fluid outputted from the left swing proportional pressure reducing valve 128.

<Stabilization Control Calculation Unit>

As described hereinabove, the control calculation unit 60*a* functions as a stabilization control calculation unit and performs, in the stabilization control system 190 of the present embodiment, gradual stoppage and operation speed limitation as operation limitation for keeping the work machine 1 stable. The stabilization control calculation unit 60*a* evaluates the stability of the work machine 1 on the basis of results of detection of the state quantity detection unit 30, judges whether or not operation limitation is required on the basis of a result of the stability evaluation. If the operation limitation is required, the stabilization control calculation unit 60*a* outputs a control command pilot pressure for gradual stoppage (hereinafter referred to as gradual stoppage command value) and a control command pilot pressure for operation speed limitation (hereinafter referred to as operation speed limitation value).

Although various methods are available as an evaluation method of stability and a determination method of operation limitation of the work machine 1, in the description of the present embodiment, the methods are described taking a case in which a method of calculating operation limitation on the basis of a behavior prediction upon sudden stopping using a ZMP as a stability evaluation index is applied as an example.

As described hereinabove, upon such sudden stopping as upon returning of the control lever 50 at an instant from an operation state to a stoppage command state, high inertial force acts in the falling direction and the work machine 1 is likely to be destabilized. Therefore, in the stabilization control calculation unit 60*a* of the present embodiment, the behavior of the work machine 1 when it is assumed that a sudden stoppage operation is performed, and operation limitation is determined such that the stable state is kept also upon a sudden stoppage operation.

As a method for calculating operation limitation for keeping the work machine 1 stable, a method by an inverse operation from stabilization conditions and a method by a forward operation of repeating behavior prediction and stability evaluation by a plural number of times changing operation limitation to be applied are available. Although the former method can calculate optimum operation limitation by a single time calculation, it is necessary to derive a complicated arithmetic equation. On the other hand, although the latter method requires a plurality of trials, a comparatively simple arithmetic equation can be used. In the following description, the latter technique is described as an example.

As depicted in FIG. 3B, the stabilization control calculation unit 60*a* is configured from functional blocks of a speed estimation section 60*b*, a sudden stop behavior prediction section 60*c*, a stability judgment section 60*d* and an operation limitation determination section 60*h*. The speed estimation section 60*b* estimates an operation speed of each drive actuator from a result of detection of the state quantity detection unit 30. The sudden stop behavior prediction section 60*c* predicts a behavior of the work machine 1 until, assuming that a sudden stoppage operation is performed, the work machine 1 stops completely. The stability judgment section 60*d* calculates a ZMP locus of a sudden stopping procedure on the basis of a result of prediction of the sudden stop behavior prediction section 60*c* to judge the stability. Further, the operation limitation determination section 60*h* judges whether or not operation limitation is required on the basis of a result of judgment of the stability judgment section 60*d* and outputs a gradual stoppage command and an operation speed limitation command.

<<Stability Evaluation Based on ZMP>>

Before details of the functional blocks of the stabilization control calculation unit 60*a* are described, the ZMP used for evaluation of the stability of the work machine 1 in the present embodiment and a stability judgment method (ZMP stability discrimination norm) in which the ZMP is used are described. It is to be noted that a concept of the ZMP and a ZMP stability discrimination norm are described in detail in "LEGGED LOCOMOTION ROBOTS": by Miomir Vukobratovic ("Walking Robots and Artificial Feet: translated by Ichiro KATOH, NIKKAN KOGYO SHIMBUN, Ltd.").

The ZMP signifies a point of a road surface at which the moment applied to an object is zero. Although the gravity, inertial force, external force and moments of them act upon the earth surface 29 from the work machine 1, according to the principle of D'Alembert, they balance with the floor reaction force and the floor reaction force movement as a reaction from the earth surface 29 to the work machine 1. Accordingly, where the work machine 1 contacts stably with the earth surface 29, a point at which moments in pitch-axis and roll-axis directions are zero exists on or on the inner side of a side of a support polygon that connects the work machine 1 and the earth surface 29 such that it does not have a concave shape. This point is called ZMP. Conversely speaking, if the ZMP exists in the support polygon and force acting upon the earth surface 29 from the work machine 1 is directed so as to push the earth surface 29, then it can be considered that the work machine 1 contacts stably with the ground.

As the ZMP comes near to the center of the support polygon, the stability increases, and if the ZMP is positioned on the inner side of the support polygon, then the work machine 1 keeps a stable state and can perform work without falling. On the other hand, if the ZMP exists on the support polygon, then the work machine 1 begins to fall. Accordingly, the stability can be judged by comparing the ZMP and the support polygon formed from the work machine 1 and the earth surface 29 with each other.

The ZMP is calculated using the following equation (1) that is derived from the balance of moments generated by the gravity, inertial force and external force.

[Equation 1]

$$\sum_i m_i(r_i - r_{zmp}) \times r_i'' - \sum_j M_j - \sum_k (s_k - r_{zmp}) \times F_k = 0 \quad (1)$$

where rzmp: ZMP position vector mi: mass of the ith mass point ri: position vector of the ith mass point r"i: acceleration vector (including gravitational acceleration) applied to the ith mass point Mj: jth external force moment sk: kth external force action point position vector Fk: kth external force vector It is to be noted that each vector is a three-dimensional vector configured from an X component, a Y component and a Z component.

The ZMP when the work machine 1 is in a stationary state and only the gravity acts upon the work machine 1 coincides with a projection point of the center of gravity (center of mass) of the work machine 1 to the earth surface 29. Accordingly, it is possible to handle the ZMP as a projection point of the center of gravity to the earth surface 29 taking both of a dynamic state and a static state into consideration, and by using the ZMP as an index, both of a case in which the work machine 1 is stationary and another case in which the work machine 1 is performing an operation can be handled in an integrated manner.

<<Speed Estimation Section>>

The speed estimation section 60*b* estimates an operation speed of each drive actuator caused by a lever operation at present on the basis of a result of detection by the state quantity detection unit 30. Generally, although the operation speed of each drive actuator of the work machine 1 varies depending upon a work situation or a load state, it varies generally in proportion to the operation amount of the corresponding control lever 50, namely, to a lever operation pilot pressure. Since a delay by a hydraulic pressure and a mechanism exists between an operation of the control lever 50 and an operation speed, the operation speed in the near future can be predicted by using the lever operation information. Therefore, the speed estimation section 60*b* predicts an operation speed in the near future using a lever operation pilot pressure in the past, a lever operation pilot pressure at present and an operation speed at present.

In particular, the speed estimation section 60*b* first identifies a speed calculation model from a lever operation pilot pressure in the past and an operation speed at present. Then, the speed estimation section 60*b* inputs the lever operation pilot voltage at present to the identified speed calculation model to predict an operation speed in the near future. Although it is anticipated that the speed calculation model changes from moment to moment depending upon the engine speed, magnitude of the load, attitude, fluid temperature and so forth, since the change in work situation is small in a very short period of time, it may be considered that the change of the model is small. As a simpler and easier method for implementing the speed estimation section 60*b*, a method is available which uses a waste time TL after a control lever 50 is operated until the associated drive actuator begins to move and a proportionality constant αv of the lever operation pilot pressure and the operation speed are used. Here, the waste time TL is determined in advance assuming that it does not vary. The speed after TL seconds is calculated in accordance with the following procedure.

(Step 1)

The proportionality constant αv is calculated from the lever operation pilot pressure Plev(t-TL) before TL seconds and the speed V(t) at present using the following equation (2).

[Equation 2]

$$\alpha_v = v(t)/P_{lev}(t-T_L) \quad (2)$$

(Step 2)

The estimated value v(t+TL) of the speed after TL seconds is calculated from the calculated proportionality constant αv and the lever operation pilot pressure Plev(t) at present using the following equation (3).

[Equation 3]

$$v(t+T_L) = \alpha_v P_{lev}(t) \quad (3)$$

<<Sudden Stop Behavior Prediction Section>>

The sudden stop behavior prediction section 60*c* predicts a behavior of the work machine 1 upon sudden stoppage command assuming that sudden stoppage command is performed. The sudden stop behavior prediction section 60*c* calculates a position locus, a speed locus and an acceleration locus after sudden stoppage command is performed until an associated drive actuator stops completely from attitude information at present, a speed estimation result of the speed estimation section 60*b* and a sudden stop model. The sudden stopping model may be created, for example, by a method of modeling a speed locus upon sudden stopping and calculating a position locus and an acceleration locus from the speed locus. Where the cylinder speed at te seconds after time t (time at which the control lever is opened) with the speed locus upon sudden stoppage command modeled in advance is given as Vstop(t,te), the cylinder length lstop(t,te) and the cylinder acceleration astop(t,te) after te seconds are calculated from the cylinder length l stop(t,t0) upon starting of sudden stopping in accordance with the following equation (4).

[Equation 4]

$$l_{stop}(t, t_e) = l_{stop}(t, 0) + \int_0^{t_e} v_{stop}(t, u)du \tag{4}$$

$$a_{stop}(t, t_e) = \frac{v_{stop}(t, u)}{du}\bigg|_{u=t_e}$$

To perform sudden stop behavior prediction on the real time basis, a speed locus upon sudden stopping may be modeled with a simple model. The simple model of the speed locus upon sudden stopping may be a first order delay system, a multi-order delay system or a polynomial function. Since the stabilization control in the present embodiment involves gradual stoppage, similar modeling is performed also for a behavior upon gradual stoppage command in addition to sudden stoppage command.

<<Stability Judgment Section<<

The stability judgment section 60*d* calculates a ZMP locus in a sudden stopping procedure using the sudden stopping locus calculated by the sudden stop behavior prediction section 60*c* to judge the stability.

In particular, the stability judgment section 60*d* first calculates a position vector locus and an acceleration vector locus of the center of gravity of a principal component of the work machine 1 using the prediction result of the sudden stop behavior prediction section 60*c*. Then, the stability judgment section 60*d* calculates a ZMP locus using the equations (5) and (6) given below which are derived from the equation (1).

[Equation 5]

$$r_{zmpx} = \frac{\sum_i m_i(r_{ix}r''_{iz} - r_{iz}r''_{ix}) - \sum_k (s_{kx}F_{kz} - s_{kz}F_{kx})}{\sum_i m_i r''_{iz} - \sum_k F_{kz}} \tag{5}$$

[Equation 6]

$$r_{zmpy} = \frac{\sum_i m_i(r_{iy}r''_{iz} - r_{iz}r''_{iy}) - \sum_k (s_{ky}F_{kz} - s_{kz}F_{ky})}{\sum_i m_i r''_{iz} - \sum_k F_{kz}} \tag{6}$$

By substituting the sudden stop position vector of the center of gravity of each principal component into r of the equation given above and substituting the sudden stopping acceleration vector locus into r", the ZMP locus upon sudden stopping can be calculated.

Then, the stability judgment section 60*d* judges the stability upon sudden stopping using the calculated ZMP locus upon sudden stopping. If the ZMP exists in the region sufficiently on the inner side of a support polygon L defined by the work machine 1 and the earth surface 29 as described hereinabove, then there is little possibility that the work machine 1 may be destabilized, and therefore, the work machine 1 can perform a work stably. Where the track structure 2 erects on the earth surface 29, the support polygon L is equal to a planar shape of the track structure 2. Accordingly, where the planar shape of the track structure 2 is a rectangle, the support polygon L has a rectangular shape as depicted in FIG. 9. More particularly, the support polygon L where the work machine 1 has a crawler as the track structure 2 is such a quadrangle that a front border line is given by a line segment that connects the central points of left and right sprocket wheels to each other; a rear boundary line is given by a line segment that connects the central points of left and right idlers; and left and right border lines are given by outer side ends of left and right track links. It is to be noted that the front and rear boundaries may otherwise be defined by grounding points of the frontmost lower roller and the rearmost lower roller.

The stability judgment section 60*d* divides the support polygon L into a normal region J in which the possibility that the work machine 1 may become unstable is sufficiently low and a stability warning region N in which the possibility described above is high, and judges the stability by judging in which one of the regions the ZMP exists. Usually, the boundary K between the normal region J and the stability warning region N is set to a polygon formed by contracting the support polygon L to the center point side according to a ratio determined in accordance with a safety ratio, or to a polygon obtained by moving the support polygon L to the inner side by a length determined in accordance with the safety ratio. The stability judgment section 60*d* outputs a stability judgment result as "stable" when all points on the ZMP locus upon sudden stopping remain within the normal region J. On the other hand, when the ZMP locus upon sudden stopping enters the stability warning region N, namely, when the ZMP enters into the stability warning region N at some point of time in the sudden stopping procedure, the stability judgment section 60*d* outputs the judgment result as "unstable."

<<Action Restriction Determination Section>>

The operation limitation determination section 60*h* judges whether or not operation limitation is required on the basis of a result of judgment of the stability judgment section 60*d* and calculates an operation limitation command. The stabilization control system 190 in the present embodiment performs gradual stoppage and operation speed limitation in order to keep the work machine 1 stable. Accordingly, the operation limitation determination section 60*h* calculates a gradual stoppage command value and an operation speed limitation command value as an operation limitation command value and outputs the operation limitation command value to the command value generation unit 60*i*.

As described above, the stabilization control calculation unit 60*a* in the present embodiment repeats behavior prediction and stability evaluation by a plural number of times as occasion demands to calculate operation limitation necessary for stabilization as described hereinabove. A requirement judgment method regarding operation limitation and an repetitive calculation is described with reference to FIG. 10.

Figure 10:
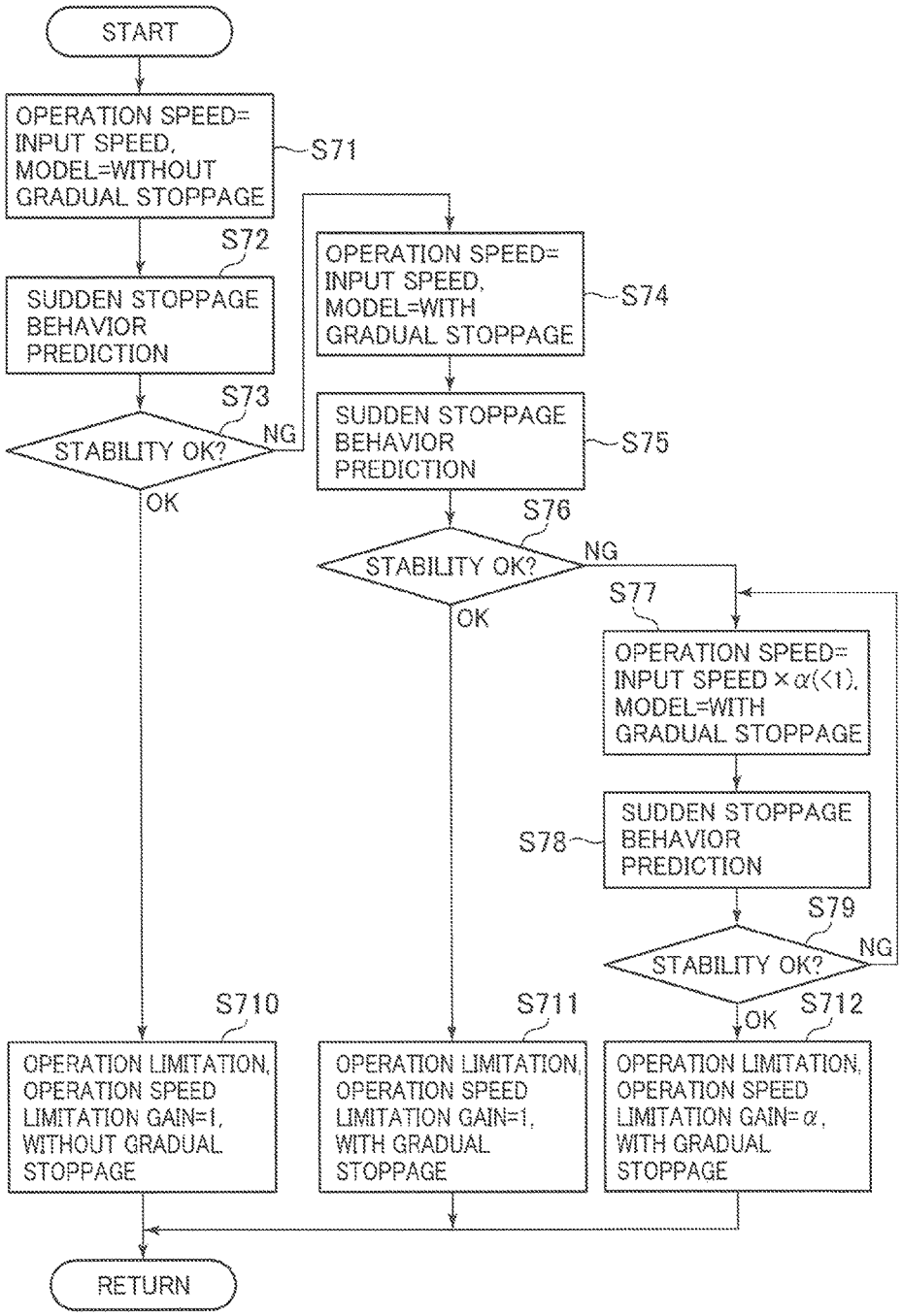
FIG. 10 is a flow chart illustrating a calculation procedure by an operation limitation determination section in the first embodiment.

Referring to FIG. 10, it is set that, in the first trial, an estimation result and a sudden stopping model of the speed estimation section 60*b* are to be used (step S71), and behavior prediction (step S72) and stability judgment (step S73) are performed.

If a result of the judgment at step S73 is "stable," then operation limitation is not performed (OK at step S73). In this case, "no gradual stoppage" and "operation speed limitation gain=1" are outputted (step S710).

On the other hand, if the judgment result of the stability judgment section 60*d* is "unstable" (NG at step S73), then it is set that a gradual stoppage model is to be used in place of the sudden stopping model (step S74), and behavior prediction (step S75) and stability judgment (step S76) after the setting change is performed.

If a result of judgment of the stability judgment section 60*d* at step S76 is "stable" (OK at step S76), then the operation speed limitation gain is set to 1 and operation limitation command is performed such that only gradual stoppage is performed (step S711).

On the other hand, if the judgment result of the stability judgment section 60*d* is "unstable" (NG at step S76), then it is set that the product of the speed estimation value by the operation speed limitation gain a (<1) and a gradual stoppage model are used (step S77), and behavior prediction (step S78) and stability judgment (step S79) after the setting change are performed.

If the judgment result of the stability judgment section 60*d* is "stable" (OK at step S79), then operation limitation command is performed such that operation speed limitation of the gradual stoppage command and the operation speed limitation gain a is performed (step S712).

On the other hand, if the judgment result of the stability judgment section 60*d* is "unstable" (NG at step S79), then the operation speed limitation gain a is gradually decreased, and the behavior prediction (step S78) and the stability judgment (step S79) are repeated until after the judgment result of the stability judgment section 60*d* becomes "stable."

It is to be noted that, while the foregoing description is directed to a case in which a single stoppage characteristic is selected upon gradual stoppage command, a plurality of stoppage characteristics may be set such that the degree of gradual stoppage is changed in response to a stable state. As an index representative of the degree of gradual stoppage, for example, a period of time required for stopping (stopping time period), a distance required for stopping (braking distance), a deceleration acceleration, a decreasing amount of the pilot pressure per unit time period (pilot pressure changing rate) and so forth are available. Where a plurality of settings are provided, a stoppage characteristic to be satisfied in each setting is determined in advance. Further, the operation limitation determination section 60*h* calculates an operation limitation command value such that the operation speed is limited only after the stability judgment result of instability is obtained for all gradual stoppage settings.

<Part 2 of Command Value Generation Apparatus>

The command value generation unit 60*i* generates a drive command value for the pilot pressure correction unit 200 on the basis of a gradual stoppage command and an operation speed limitation command outputted from the stabilization control calculation unit 60*a* and outputs the drive command value to the output unit 60*y* of the calculation device 60.

More particularly, the command value generation unit 60*i* calculates a drive command value for the speed increasing unit 210 from the gradual stoppage value and calculates a drive command value for the speed reducing unit 240 from the operation speed limitation gain. In the stabilization control system 190 of the present embodiment, as depicted in FIG. 4A, speed increasing units 211, 212, 213 and 214 and speed reducing units 241, 242, 243 and 244 are provided in pilot lines for boom expansion, boom contraction, arm expansion and arm contraction, respectively. The command value generation unit 60*i* calculates a drive command value for each of the speed increasing units 211, 212, 213 and 214 and the speed reducing units 241, 242, 243 and 244. In the following, a calculation method of a drive command value for the boom expansion speed increasing unit 211 and the boom expansion speed reducing unit 241 is described taking correction of boom expansion pilot hydraulic fluid as an example.

It is to be noted that, in the following description, since a speed increasing unit is an unit for performing changing of a stoppage characteristic upon gradual stoppage, it is referred to as stoppage characteristic modification unit, and since a speed reducing unit is an unit for performing operation speed limitation, it is referred to as operation speed limitation unit. Further, each of the speed increasing solenoid proportional valves 221 and 222 included in the speed increasing unit is referred to as gradual stoppage solenoid proportional valve, and each of the speed reducing solenoid proportional valves 251 and 252 included in the speed reducing unit is referred to as speed limitation solenoid proportional valve.

Meanwhile, the boom expansion speed increasing solenoid proportional valve 221 is referred to as boom expansion gradual stoppage solenoid proportional valve, and the boom contraction speed increasing solenoid proportional valve 222 is referred to as boom contraction gradual stoppage solenoid proportional valve. Further, the boom expansion speed reducing solenoid proportional valve 251 is referred to as boom expansion speed limitation solenoid proportional valve, and the boom contraction speed reducing solenoid proportional valve 252 is referred to as boom contraction speed limitation solenoid proportional valve. The high speed selection units 231 and 232 are referred to each as gradual stoppage high pressure selection unit.

First, a calculation method of a drive command value of the boom expansion stoppage characteristic modification unit 211 is described. As described hereinabove with reference to FIG. 4B, the stoppage characteristic modification unit 211 is configured from the gradual stoppage solenoid proportional valve 221 and the gradual stoppage high pressure selection unit 231. In the stoppage characteristic modification unit 211, when a sudden deceleration operation or a stoppage operation is performed, an associated drive actuator is stopped gradually by driving the gradual stoppage solenoid proportional valve 221 such that pilot hydraulic fluid that satisfies the gradual stoppage command outputted from the operation limitation determination section 60*h* is generated.

As a calculation method of a drive command value for performing gradual stoppage, various methods are available depending upon a setting method of a stoppage characteristic upon gradual stoppage. In the following, the calculation method is described taking a case in which a command of a rate of change of the pressure of pilot hydraulic fluid to be supplied to the boom flow control valve 111 as a stoppage characteristic is issued and the lever operation pilot pressure is corrected using a correction curve indicated by a solid line in FIG. 5A as an example.

As described hereinabove, the pressure of the pilot hydraulic fluid to be supplied to the boom flow control valve 111 and the operation speed of the drive actuator has a proportional relationship. Therefore, when the rate of change of the lever operation pilot pressure upon deceleration operation and upon stoppage operation is higher than a command value, the drive actuator decelerates more quickly than the commanded stoppage characteristic, but when the rate of change is lower than the command value, the drive actuator decelerates more gradually than the commanded stoppage characteristic. It is necessary for the stabilization control system 190 in the present embodiment to perform operation limitation when the drive actuator stops more quickly than the commanded stoppage characteristic.

Therefore, the command value generation unit 60*i* first compares the rate of change of the lever operation pilot pressure and a rate-of-change command value with each other. Then, if the rate of change of the lever operation pilot pressure is higher than the rate-of-change command value, then the command value generation unit 60*i* corrects the pilot pressure such that the pilot pressure indicates a monotonically decreasing variation satisfying the rate-of-change command value using a correction curve indicated by a solid line in FIG. 5A. In particular, the command value generation unit 60*i* sets the pressure of pilot hydraulic fluid to be outputted from the stoppage characteristic modification unit 211 in accordance with the following equation (7).

[Equation 7]

$$P_{211}(t) = \begin{cases} P_{lev}(t) & (\text{when } P_{lev}(t) - P_{lev}(t-\Delta t) < k\Delta t) \\ P_{lev}(t-\Delta t) - k\Delta t & (\text{when } P_{lev}(t) - P_{lev}(t-\Delta t) \geq k\Delta t) \end{cases} \quad (7)$$

where Plev(t) is a lever operation pilot pressure at time t; P211(*t*) a pressure of pilot hydraulic fluid to be outputted from the stoppage characteristic modification unit 211 at time t; and k a pilot pressure rate-of-change command value. When the stoppage characteristic modification unit 211 outputs a lever operation pilot hydraulic fluid without correcting the same, there is no requirement to drive the gradual stoppage solenoid proportional valve 221, and only when the rate of change of the lever operation pilot pressure is higher than the rate-of-change command value, the gradual stoppage solenoid proportional valve 221 may be driven such that gradual stoppage pilot hydraulic fluid of a pressure calculated in accordance with the equation (7) is generated. Accordingly, a command value for the gradual stoppage solenoid proportional valve 221 is calculated in accordance with the following equation (8).

[Equation 8]

$$P_{221c}(t) = \begin{cases} 0 & (\text{when } P_{lev}(t) - P_{lev}(t-\Delta t) < k\Delta t) \\ P_{lev}(t-\Delta t) - k\Delta t & (\text{when } P_{lev}(t) - P_{lev}(t-\Delta t) \geq k\Delta t) \end{cases} \quad (8)$$

where P221*c*(*t*) is a command pressure for the gradual stoppage solenoid proportional valve 221 at time t.

Figure 5C:
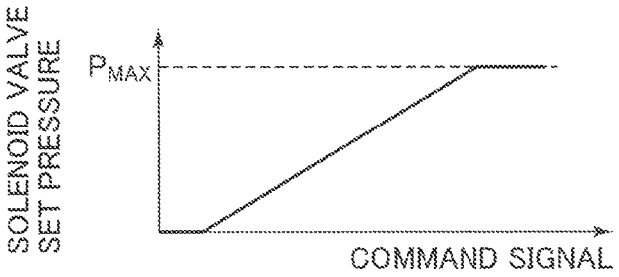
FIG. 5C is a view illustrating an example of an output characteristic (relationship between a command signal and a solenoid valve set pressure) of the speed increasing solenoid proportional valve according to the first embodiment.
Figure 5D:
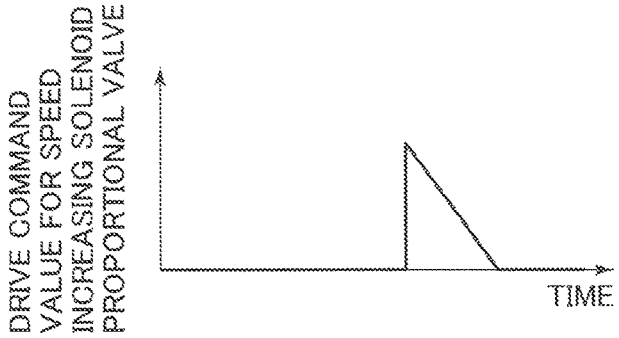
FIG. 5D is a view illustrating an example of a relationship between a drive command value for the speed increasing solenoid proportional valve according to the first embodiment and time.

The pressure of hydraulic fluid to be outputted from the gradual stoppage solenoid proportional valve 221 is determined depending upon the magnitude of a command signal, and the relationship between the command signal and the pressure is given as an output characteristic of the valve as depicted in FIG. 5C. The drive command value to the gradual stoppage solenoid proportional valve 221 is determined using the command value calculated in accordance with the equation (8) and an output characteristic of the gradual stoppage solenoid proportional valve 221. For example, the drive command value to the gradual stoppage solenoid proportional valve 221 when correction indicated by the solid line in FIG. 5A is calculated in such a manner as illustrated in FIG. 5D.

In the stabilization control system 190 of the present embodiment, four gradual stoppage solenoid proportional valves are provided including the boom expansion gradual stoppage solenoid proportional valve 221, boom contraction gradual stoppage solenoid proportional valve 222, arm expansion gradual stoppage solenoid proportional valve (not depicted) and arm contraction gradual stoppage solenoid proportional valve (not depicted) are provided in order to perform operation limitation for the boom cylinder 11 and the arm cylinder 13. The command value generation unit 60*i* calculates, for each of the gradual stoppage solenoid proportional valves, a drive command value using a corresponding lever operation pilot pressure.

Now, a calculation method of a drive command value of the boom expansion operation speed limitation unit 241 is described. As described hereinabove, in the present embodiment, the speed limiting solenoid proportional valve 251 is provided as the operation speed limitation unit 241 and determines an upper limit value for pilot hydraulic fluid to be supplied to the pilot port of the boom flow control valve 111 in accordance with a drive command value to the speed limiting solenoid proportional valve 251. Since the operation speed of a drive actuator generally increases in proportion to the pilot pressure, the operation speed limitation unit 241 may calculate a drive command value for the speed limiting solenoid proportional valve 251 on the basis of an operation speed limitation command (operation speed limitation gain) outputted from the operation limitation determination section 60*h*.

In particular, if a maximum drive command is provided to the speed limiting solenoid proportional valve 251, inputted hydraulic fluid is outputted without being corrected irrespective of the pressure of pilot hydraulic fluid inputted from the stoppage characteristic modification unit 211 to the speed limiting solenoid proportional valve 251. Accordingly, when the operation speed limitation gain is 1, the operation speed limitation unit 241 performs maximum drive command to the speed limiting solenoid proportional valve 251.

On the other hand, where the operation speed limitation gain is lower than 1, since it is necessary to decrease the lever operation pilot pressure, the operation speed limitation unit 241 performs drive command such that the lever operation pilot pressure is decreased in response to the operation speed limitation gain. Here, the operation speed limitation gain represents a deceleration rate necessary from an operation speed commanded by a lever operation and may be considered as a decompression rate to be applied to the lever operation pilot pressure. In other words, the speed limiting solenoid proportional valve 251 may be driven such that the pressure of corrected pilot hydraulic fluid to be outputted from the speed limiting solenoid proportional valve 251 may be lower than a pressure obtained by multiplying the lever operation pilot pressure by the operation speed limitation gain. Accordingly, the command pressure for the speed limiting solenoid proportional valve 251 is calculated in accordance with the following equation 9.

[Equation 9]

$$P_{251c}(t) = \begin{cases} P_{MAX} & (\text{when } \alpha = 1) \\ \alpha P_{lev}(t) & (\text{when } \alpha < 1) \end{cases} \quad (9)$$

where P251$c(t)$ is a command value for the speed limiting solenoid proportional valve 251 at time t, and PMAX is a rated pressure for the speed limiting solenoid proportional valve 251

Figure 6C:
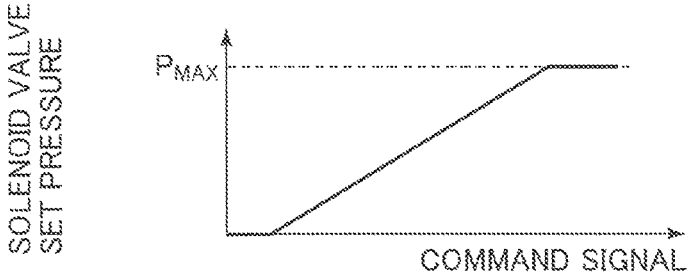
FIG. 6C is a view depicting an example of an output characteristic (relationship between a command signal and a solenoid valve set pressure) of the speed reducing solenoid proportional valve according to the first embodiment.
Figure 6D:
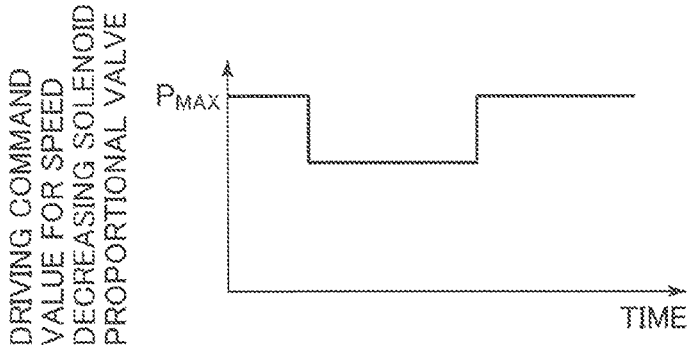
FIG. 6D is a view illustrating an example of a relationship between a drive command value for the speed reducing solenoid proportional valve according to the first embodiment and time.

Similarly as in the case of the gradual stoppage solenoid proportional valve 221, the pressure of hydraulic fluid outputted from the speed limiting solenoid proportional valve 251 is determined depending upon the magnitude of the command signal, and the relationship between the command signal and the pressure is given as an output characteristic of the valve in such a manner a depicted in FIG. 6C. The drive command value to the speed limiting solenoid proportional valve 251 is determined using a command value calculated in accordance with the equation (9) and an output characteristic of the speed limiting solenoid proportional valve 251. For example, the drive command value to the speed limiting solenoid proportional valve 251 when correction indicated by a solid line in FIG. 6A is to be performed is calculated in such a manner as illustrated in FIG. 6D.

The stabilization control system 190 in the present embodiment includes four speed limiting solenoid proportional valves including the boom expansion speed limiting solenoid proportional valve 251, boom contraction speed limiting solenoid proportional valve 252, arm expansion speed limiting solenoid proportional valve (not depicted) and arm contraction speed limiting solenoid proportional valve (not depicted) in order to perform operation limitation for the boom cylinder 11 and the arm cylinder 13. The command value generation unit 60*i* calculates a drive command value for each of the solenoid proportional valves. The drive command value is calculated using the equation (9) above from the corresponding lever operation pilot pressure. By calculating a drive command value on the basis of a lever operation pilot pressure in this manner, even when the relationship between the pilot pressure and the operation speed varies depending upon a work situation, operation speed limitation commanded from the stabilization control calculation unit 60*a* can be implemented with certainty by the speed limiting solenoid proportional valve 251.

<Effect>

As described above, according to the present embodiment, even when an unreasonable operation or an incorrect operation is performed for the work machine 1, operation limitation necessary to keep the work machine 1 stable is performed, and the work can be continued without impairing the stability. Further, in the present embodiment, only when operation limitation is required, correction by the pilot pressure correction unit 200 is performed, but when no operation limitation is required, the drive actuators are driven using pilot hydraulic fluid outputted from the proportional pressure reducing valve set similarly as in the prior art. Therefore, operation limitation can be performed without impairing the conventional operability. Accordingly, according to the present embodiment, a work machine having high operability and stability can be provided.

Further, according to the present embodiment, even when some trouble occurs with the speed increasing solenoid proportional valve 220 (gradual stoppage solenoid proportional valve) provided on a pilot line, an unintended operation of the drive actuator can be avoided while advantage is taken of operation of the drive actuator by a lever operation.

Further, since the speed reducing solenoid proportional valve 250 (speed limiting solenoid proportional valve) is formed from a solenoid proportional valve having a characteristic of the normally close type which interrupts supply of hydraulic fluid when a control command is not received from the calculation device 60, even if a failure occurs with a drive circuit for the speed reducing solenoid proportional valve, the drive actuator can be maintained in a stopping state.

According to the present embodiment, such various advantageous effects as described hereinabove can be achieved.

—Modifications—

<Addition of Failure Measures for Speed Increase Interruption Solenoid Selector Valve>

Figure 8:
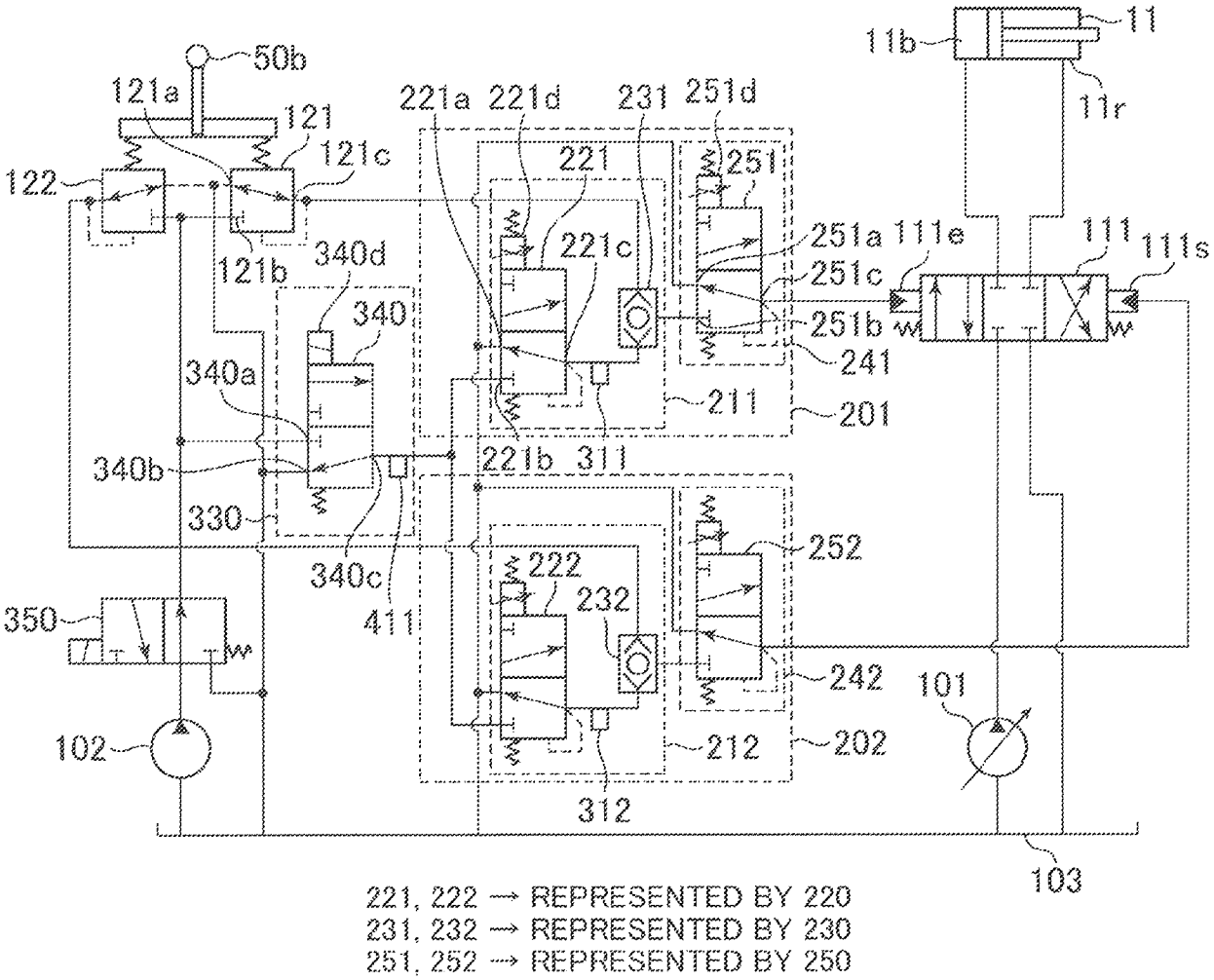
FIG. 8 is a schematic view depicting a configuration of a drive hydraulic circuit for a boom cylinder including a pilot pressure correction unit according to another modification to the first embodiment.

The embodiment described above is directed to an example in which the speed increase interruption solenoid selector valve 340 is provided as the speed increase interruption unit 330 such that, when a failure occurs with the speed increasing solenoid proportional valve 220, the speed increase interruption solenoid selector valve 340 invalidates the speed increasing function. However, there is the possibility that also the speed increase interruption solenoid selector valve 340 may suffer from a failure similarly to other solenoid valves. As depicted in FIG. 8, for example, a pressure sensor 411 may be provided on the third port 340*c* side of the speed increase interruption solenoid selector valve 340 to detect a failure of the speed increase interruption solenoid selector valve 340. If a failure of the speed increase interruption solenoid selector valve 340 is detected, then the command pressure of the speed reducing solenoid proportional valve 250 is set so as to be lower than the lever operation pilot pressure such that such a situation that, when the speed increasing solenoid proportional valve 220 fails, the drive actuator continues the unintended operation and is disabled from stopping is avoided.

<Modification to Command Value Generation Unit>

The embodiment described above is directed to an example in which the command value generation unit 60*i* uses such a determination method as illustrated in FIG. 5A as a determination method of a speed increasing solenoid proportional valve command pressure for the speed increasing solenoid proportional valve 220. However, a control command pilot pressure may always be used as the speed increasing solenoid proportional valve command value irrespective of the relationship in magnitude between the control command pilot pressure and the lever operation pilot pressure as illustrated in FIG. 5B. The method illustrated in FIG. 5A is advantageous in that driving of the speed increasing solenoid proportional valve 220 can be restricted, that the current consumption can be maintained low and that failure judgment can be performed readily. On the other hand, since the lever operation pilot pressure and the control command pilot pressure are compared with each other, it is necessary to provide the pressure sensors 51 to 58 for detecting a lever operation pilot pressure in order to compare the lever operation pilot pressure and the control command pilot pressure with each other. Further, where the responsiveness of the speed increasing solenoid proportional valves is low, there is the possibility that the pressure may temporarily decrease due to a time lag of activation to a command pressure. In contrast, with the method illustrated in FIG. 5B, since hydraulic fluid of some pressure is always outputted, although the current consumption increases, there is no necessity to detect the lever operation pilot pressure.

Further, there is an advantage that the method is less likely to be influenced by the responsiveness.

Further, although the determination method of a speed reducing solenoid proportional valve command pressure for the speed reducing solenoid proportional valve 250 is described using an example in which a speed reducing solenoid proportional valve command pressure is determined in such a manner as depicted in FIG. 6A. However, the control command pilot pressure may always be used as the speed reducing solenoid proportional valve command value irrespective of the relationship in magnitude between the control command pilot pressure and the lever operation pilot pressure as depicted in FIG. 6B. In comparison with the method illustrated in FIG. 6A, according to the method illustrated in FIG. 6B, when the responsiveness of the speed reducing solenoid proportional valve is low, there is the possibility that a rise of the corrected pilot pressure may be delayed from a rise of the lever operation pilot pressure. However, there is no necessity to provide a pressure sensor for detecting the lever operation pilot pressure to be used for comparing the lever operation pilot pressure and the control command pilot pressure with each other, and the condition for outputting a maximum command signal is restricted. Therefore, there is an advantage that the current consumption decreases.

<Modification to Speed Increase Interruption Solenoid Selector Valve>

While the embodiment described above is directed to an example in which a solenoid selector valve having a characteristic of the normally closed type is used as the speed increase interruption solenoid selector valve 340, only it is necessary for the speed increase interruption solenoid selector valve 340 to have a function for interrupting supply of hydraulic fluid delivered from the pilot pump 102 to the speed increasing solenoid proportional valve 220 in accordance with a command from the calculation device 60, and, for example, a solenoid proportional valve having a characteristic of the normally open type may be used as the speed increase interruption solenoid selector valve 340. In the solenoid selector valve of the normally open type, if the solenoid 340*d* is placed into an non-excited state, then a supply state in which supply of hydraulic fluid from the pilot pump 102 is permitted is established, but if the solenoid 340*d* is placed into an excited state, then an interruption state in which supply of hydraulic fluid from the pilot pump 102 is interrupted is established. Accordingly, if the speed increasing valve failure judgment unit 60*f* of the calculation device 60 detects a failure of any of the speed increasing solenoid proportional valves 220, then the solenoid 340*d* may be placed into an excited state, but in a normal state, the solenoid 340*d* may be controlled to a non-excited state.

<Modification to Speed Increasing Solenoid Proportional Valve, Speed Reducing Solenoid Proportional Valve>

The embodiment described hereinabove is directed to an example in which a solenoid proportional valve having a characteristic of the normally closed type is used for the speed increasing solenoid proportional valve 220 and the speed reducing solenoid proportional valve 250, only it is necessary for the speed increasing solenoid proportional valve 220 and the speed reducing solenoid proportional valve 250 to have a function for decreasing the pressure of pilot hydraulic fluid to a command pressure, and, for example, a solenoid proportional valve having a characteristic of the normally closed type may be used.

Further, while the embodiment described above exhibits an example in which the speed reducing solenoid proportional valve 250 is provided as the speed reducing unit 240, for example, a solenoid proportional relief valve 260 may be used in place of the speed reducing solenoid proportional valve 250.

Figure 7:
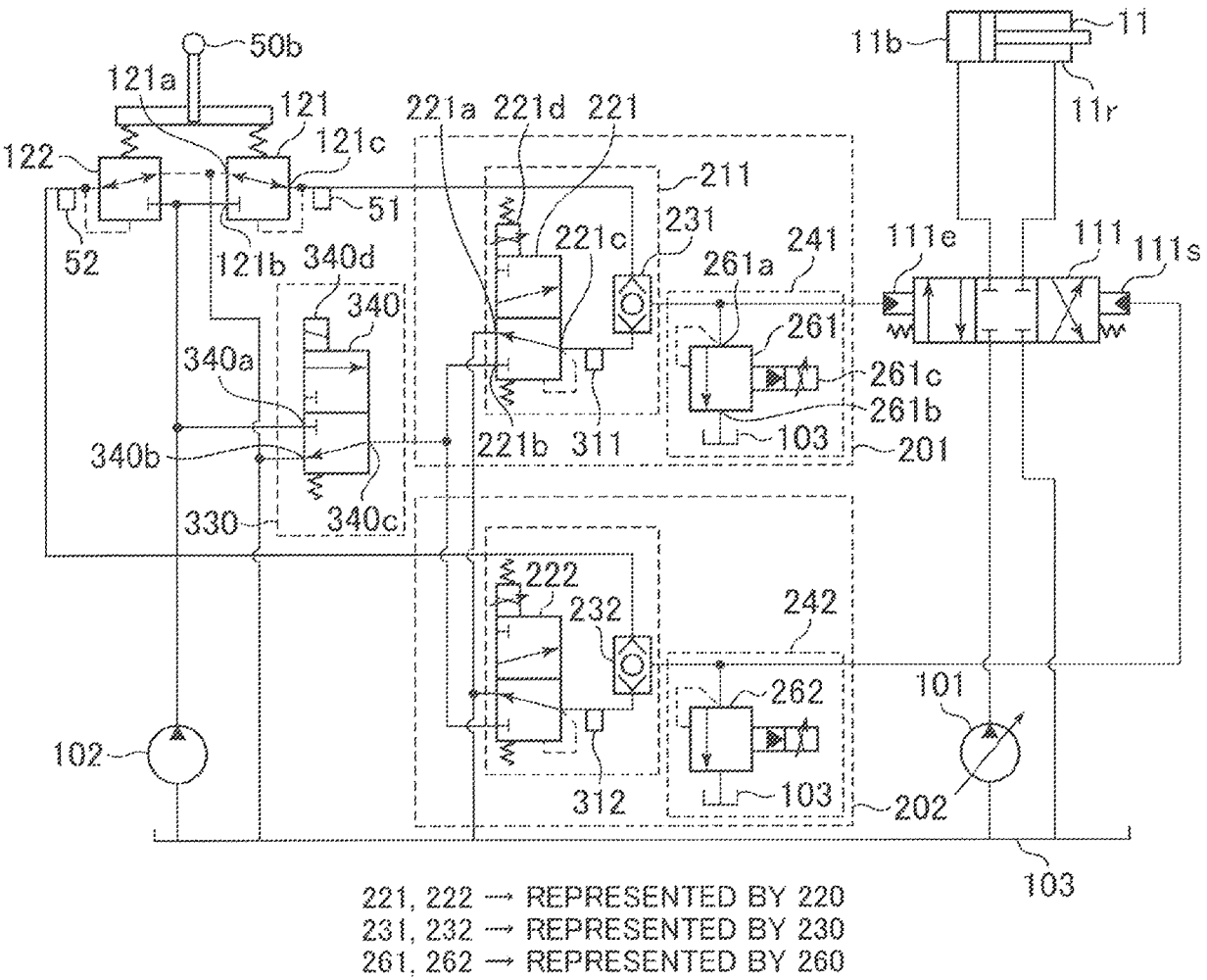
FIG. 7 is a schematic view depicting a configuration of a drive hydraulic circuit for a boom cylinder including a pilot pressure correction unit according to a modification to the first embodiment.

FIG. 7 depicts a schematic configuration of the boom expansion pilot pressure correction unit 201 where a speed reducing solenoid proportional relief valve 261 is provided as the boom expansion speed reducing unit 241. The speed reducing solenoid proportional relief valve 261 includes an input port 261*a*, a tank port 261*b* and a solenoid 261*c*. The input port 261*a* is connected to a pilot line that connects the speed increasing unit 211 and the pilot port 111*e* of the boom flow control valve 111, and the tank port 261*b* is connected to the hydraulic fluid tank 103. The solenoid 261*c* is excited by a command signal from the calculation device 60, and the set pressure of the speed reducing solenoid proportional relief valve 261 is determined by the magnitude of the command signal. Where the pressure on the input port 261*a* side is higher than the set pressure, a valve passage that communicates the input port 261*a* and the tank port 261*b* with each other is opened, and consequently, hydraulic fluid of the hydraulic line connected to the input port 261*a* is discharged into the hydraulic fluid tank 103. Consequently, the pressure of the pilot hydraulic fluid to be supplied from the speed increasing unit 211 to the pilot port 111*e* of the boom flow control valve 111 is kept equal to or lower than the set pressure. On the other hand, if the valve passage that communicates the input port 261*a* and the tank port 261*b* with each other is fully closed, then the pilot hydraulic fluid is not corrected by the speed reducing solenoid proportional relief valve 261. Accordingly, the set pressure of the speed reducing solenoid proportional relief valve 261 may be set similarly as in the case of the speed reducing solenoid proportional valve command pressure.

<Addition of Pilot Source Pressure Interruption Unit>

The embodiment described hereinabove is directed to an example in which the speed increase interruption unit 330 is provided such that, when a failure occurs with the speed increasing solenoid proportional valve 220, the speed increasing function is invalidated. However, when more reliable invalidation is required, a pilot source pressure interruption unit 350 may be provided on the hydraulic line that connects the pilot pump 102 and the proportional pressure reducing valve set 120 and speed increase interruption unit 330 to each other in addition to the speed increase interruption unit 330 as depicted in FIG. 8.

The pilot source pressure interruption unit 350 is, for example, a solenoid selector valve having a characteristic similar to that of the speed increase interruption solenoid selector valve 340 and is changed over in accordance with a command from the calculation device 60 to interrupt supply of hydraulic fluid from the pilot pump 102. If a failure of one of the speed reducing solenoid proportional valve 250 and the speed increase interruption solenoid selector valve 340 is detected, then the calculation device 60 provides a command to control the pilot source pressure interruption unit 350 to its interrupted state. If the pilot source pressure interruption unit 350 is placed into an interruption state, then since supply of pilot hydraulic fluid from the pilot pump 102 to the proportional pressure reducing valve and the speed increase interruption unit 330 is interrupted, the drive actuators stop irrespective of a command state from the control lever 50 or the calculation device 60 or of a state of the valve devices. Accordingly, it is possible to cope with a failure of a valve device other than the speed increase interruption solenoid selector valve 340, and invalidation can be performed with a higher degree of certainty.

<Modification to Failure Judgment Method>

The embodiment described hereinabove is directed to an example in which the speed increasing valve failure judgment unit 60*f* calculates a difference between a speed increasing solenoid proportional valve command pressure and an output pressure of a speed increasing solenoid proportional valve and, when the difference is greater than a predetermined value, it is judged that the speed increasing solenoid proportional valve 220 is in a "failed" state. The judgment method of a failure of the speed increasing solenoid proportional valve 220 is not limited to the method described above, and, for example, failure judgment may be performed only in a state in which no drive command to the speed increasing solenoid proportional valve 220 is provided as described below. If hydraulic fluid of a pressure higher than a tank pressure is outputted from the speed increasing solenoid proportional valve 220 despite that the drive command to the speed increasing solenoid proportional valve 220 is not performed, it may be judged that the speed increasing solenoid proportional valve 220 suffers from a failure. Accordingly, the speed increasing valve failure judgment unit 60*f* first judges the speed increasing solenoid proportional valve command value to the speed increasing solenoid proportional valve 220 is higher than a threshold value determined in advance. If the speed increasing solenoid proportional valve command value is higher than the threshold value, then a failure judgment is not performed and a failure judgment result in the preceding operation cycle is maintained. If the speed increasing solenoid proportional valve command value is equal to or lower than the predetermined value, then it is judged whether or not the detection value of the speed increasing pressure sensor is equal to or lower than a failure judgment pressure determined in advance. If the detection value of the speed increasing pressure sensor is equal to or lower than the failure judgment pressure, then it is judged that the speed increasing solenoid proportional valve 220 is "normal," but if the detection value of the speed increasing pressure sensor is higher than the failure judgment pressure, then it is judged that the speed increasing solenoid proportional valve 220 is "in failure." The failure judgment pressure to be used for the failure judgment is determined taking the tank pressure and the detection error of the pressure sensor into consideration. According to the present method, although the state in which failure judgment is performed is restricted, such a situation that the difference between the speed increasing solenoid proportional valve command value and the output pressure of the speed increasing solenoid proportional valve temporarily becomes great by an influence of a response delay of the speed increasing solenoid proportional valve 220 and it is judged in error that the speed increasing solenoid proportional valve 220 is in failure can be prevented.

<Addition of Monitoring of Feedback Current of Solenoid Proportional Valve>

The embodiment described hereinabove is directed to an example in which a pressure sensor is provided as the speed increasing valve failure detection unit 310 such that a failure of the speed increasing solenoid proportional valve 220 is detected by monitoring the output pressure of the speed increasing solenoid proportional valve 220. However, the speed increasing valve failure detection unit 310 may be configured such that current (feedback current) flowing through the solenoid of the speed increasing solenoid proportional valve 220 is monitored in addition to the output pressure of the speed increasing solenoid proportional valve 220. By monitoring the difference between the feedback current value and the command signal provided from the calculation device 60 to the speed increasing solenoid proportional valve 220, an electrically abnormal state of the speed increasing solenoid proportional valve 220 can be detected.

The embodiment described hereinabove is directed to an example in which an estimation result of the speed estimation section 60*b* is used by the sudden stop behavior prediction section 60*c*. However, the speed to be used by the sudden stop behavior prediction section 60*c* may be an operation speed at present calculated from an output value of an angle sensor. In this case, a configuration that does not include the speed estimation section 60*b* can be achieved.

While a preferred embodiment of the present invention has been described using specific terms, such description is for illustrative purposes only, and it is to be understood that changes and variations may be made without departing from the spirit or scope of the following claims.

What is claimed is:

1. A drive control system for a work machine comprising:

a work machine main body;

a front work implement attached pivotably in an upward and downward direction with respect the work machine main body and having a plurality of movable parts;

a drive actuator configured to drive each of the movable parts of the front work implement;

a microcomputer configured to perform a control calculation for controlling driving of the drive actuator;

an actuator drive hydraulic circuit including a flow control valve configured to control supply of hydraulic fluid to the drive actuator, and a proportional pressure reducing valve configured to output pilot hydraulic fluid to be supplied to the flow control valve based on an operation of a control lever;

a lever operation amount sensor configured to detect an operation amount of the control lever; and an attitude detection sensor configured to detect an attitude of the work machine, wherein the microcomputer is configured to:

predict, based on the operation amount of the control lever detected by the lever operation amount sensor and the attitude of the work machine detected by the attitude detection sensor, a behavior of the work machine when it is assumed that the work machine stops suddenly and judge stability of the work machine, and calculate and output a gradual stoppage command for limiting a deceleration of the drive actuator based on a result of the judgment of the stability to gradually stop the drive actuator and an operation speed limitation command for limiting an upper limit operation speed of the drive actuator, wherein the actuator drive hydraulic circuit includes a pilot pressure correction unit configured to correct a pilot pressure to be outputted from the proportional pressure reducing valve in response to the gradual stoppage command and the operation speed limitation command, wherein the pilot pressure correction unit includes a speed increasing unit including a speed increasing solenoid proportional valve provided on a pilot line that connects the proportional pressure reducing valve and the flow control valve and connected to a pilot hydraulic fluid supply device other than the proportional pressure reducing valve so as to generate and output a pressure higher than a pilot pressure outputted from the proportional pressure reducing valve in response to the gradual stoppage command from the microcomputer, and a higher pressure selecting valve configured to select and output a higher pressure one of the pilot hydraulic fluid outputted from the proportional pressure reducing valve and the pilot hydraulic fluid outputted from the speed increasing solenoid proportional valve, and a speed reducing unit including one of a solenoid proportional valve and a solenoid proportional relief valve configured to reduce and output the pilot pressure in response to the operation speed limitation command from the microcomputer, wherein the drive control system further comprises a failure detection sensor configured to detect an output pressure of the speed increasing solenoid proportional valve included in the speed increasing unit and detect a failure of the speed increasing solenoid proportional, wherein the actuator drive hydraulic circuit further includes a speed increase interruption solenoid selector valve disposed on a hydraulic line that connects the pilot hydraulic fluid supplying device other than the proportional pressure reducing valve and the speed increasing solenoid proportional valve to each other and configured to interrupt supply of the pilot hydraulic fluid from the pilot hydraulic fluid supply device to the speed increasing solenoid proportional valve, and wherein the microcomputer is configured to cause when a failure of the speed increasing solenoid proportional valve is detected by the failure detection sensor, the speed increase interruption solenoid selector valve to interrupt supply of the pilot hydraulic fluid to the speed increasing solenoid proportional valve.

2. The drive control system for a work machine according to claim 1, wherein the solenoid proportional valve provided in the speed reducing unit is a solenoid proportional valve having a characteristic of a normally closed type.

3. The drive control system for a work machine according to claim 1, wherein:

the actuator drive hydraulic circuit includes a plurality of the flow control valves and a plurality of the proportional pressure reducing valves, a plurality of the pilot pressure correction units provided corresponding to a plurality of pilot lines that individually connect the proportional pressure reducing valves and the flow control valves, a plurality of speed increasing solenoid proportional valves as speed increasing units of the plurality of pilot pressure correction units, and a single speed increase interruption solenoid selector valve provided as the speed increase interruption solenoid selector valve and disposed so as to interrupt supply of the pilot hydraulic fluid to all of the plurality of speed increasing solenoid proportional valves;

the failure detection sensor detects a failure of each of the plurality of speed increasing solenoid proportional valves; and the microcomputer is configured to change over, when a failure of one or more of the plurality of speed increasing solenoid proportional valves is detected, the speed increase interruption solenoid selector valve to interrupt supply of the pilot hydraulic fluid from the pilot hydraulic fluid supply device to all of the plurality of speed increasing solenoid proportional valves.

4. The drive control system for a work machine according to claim 1, wherein:

the microcomputer is configured to calculate a command pilot pressure for the pilot pressure correction unit based on a given control calculation and judge that the speed increasing solenoid proportional valve is in a failure state when a difference between the command pilot pressure and an output pressure of the speed increasing solenoid proportional valve detected by the failure detection sensor exceeds a given value.

5. The drive control system for a work machine according to claim 1, wherein:

the pilot hydraulic fluid supply device is a pilot pump that is connected as a pilot hydraulic fluid supply device for the proportional pressure reducing valve also to the proportional pressure reducing valve;

the actuator drive hydraulic circuit further includes a pilot source pressure interruption solenoid selector valve disposed on a hydraulic line that connects the pilot pump, the proportional pressure reducing valve and the speed increase interruption solenoid selector valve;

the microcomputer is configured to cause, when a failure of one of the solenoid proportional valve of the speed reducing unit the speed increase interruption solenoid selector valve is detected, the pilot source pressure interruption solenoid selector valve to interrupt supply of the pilot hydraulic fluid to the speed reducing unit and the speed increase interruption solenoid selector valve.

* * * * *